US009844783B2

(12) United States Patent
Bihn

(10) Patent No.: US 9,844,783 B2
(45) Date of Patent: Dec. 19, 2017

(54) GRAIN CRUSHING APPARATUSES AND PROCESSES

(71) Applicant: John Bihn, Ft Recovery, OH (US)

(72) Inventor: John Bihn, Ft Recovery, OH (US)

( * ) Notice: Subject to any disclaimer, the term of this patent is extended or adjusted under 35 U.S.C. 154(b) by 3 days.

(21) Appl. No.: 14/465,711

(22) Filed: Aug. 21, 2014

(65) Prior Publication Data

US 2015/0028139 A1 Jan. 29, 2015

Related U.S. Application Data

(63) Continuation-in-part of application No. 13/558,938, filed on Jul. 26, 2012, now Pat. No. 8,851,408.

(60) Provisional application No. 61/935,941, filed on Feb. 5, 2014.

(51) Int. Cl.

| | |
|---|---|
| ***B02C 4/00*** | (2006.01) |
| ***B02C 4/06*** | (2006.01) |
| ***B02C 4/08*** | (2006.01) |
| ***B02C 4/38*** | (2006.01) |
| ***B02C 4/42*** | (2006.01) |

(52) U.S. Cl.
CPC ..... *B02C 4/06* (2013.01); *B02C 4/08* (2013.01); *B02C 4/38* (2013.01); *B02C 4/42* (2013.01)

(58) Field of Classification Search
CPC ..... B02C 4/06; B02C 4/08; B02C 4/38
USPC ..... 241/6–12
See application file for complete search history.

(56) References Cited

U.S. PATENT DOCUMENTS

| | | | | |
|---|---|---|---|---|
| 2,202,892 | A | 6/1940 | Berry et al. | |
| 2,282,718 | A | 5/1942 | Fujioka | |
| 3,208,677 | A | 9/1965 | Hesse | |
| 3,548,742 | A | 12/1970 | Korntal | |
| 3,633,831 | A | 1/1972 | Marengo | |
| 4,189,503 | A * | 2/1980 | Giguere | B02C 9/04 241/7 |
| 4,196,224 | A | 4/1980 | Falk | |
| 4,608,007 | A | 8/1986 | Wood | |
| 4,716,218 | A | 12/1987 | Chen et al. | |
| 5,580,006 | A | 12/1996 | Hennenfent et al. | |
| 5,816,511 | A | 10/1998 | Bernardi et al. | |
| 6,398,036 | B1 * | 6/2002 | Griebat | B07B 13/113 209/467 |
| 6,506,423 | B2 | 1/2003 | Drouillard et al. | |
| 6,685,118 | B1 | 2/2004 | Williams, Jr. | |
| 6,899,910 | B2 | 5/2005 | Johnston et al. | |

(Continued)

*Primary Examiner* — Faye Francis
(74) *Attorney, Agent, or Firm* — Ritchison Law Offices, PC; John D. Ritchison

(57) ABSTRACT

Disclosed are grain crushing apparatuses and processes for processing grain. In one embodiment, a grain crushing apparatus includes a first and second sidewall spaced apart from one another a throat dimension in a first direction, and a first and second support shaft positioned transverse to the first and sidewall. The grain crushing apparatus also includes a first and second grain crushing roller. The grain crushing rollers are intermeshed with one another and maintained at positions spaced apart from one another such that they overlap by a distance less than the tooth height. The process is a method for the grown and harvested grain to be shelled, cleaned, stored and then incrementally or iteratively crushed by the shown apparatus or an equal type such that the crushed grain of various sizes may be separated by a sieve and remain as crushed grain with the germ protected uncut, unruptured and intact.

5 Claims, 35 Drawing Sheets

(56) References Cited

U.S. PATENT DOCUMENTS

| | | | | |
|---|---|---|---|---|
| 6,953,165 | B1 * | 10/2005 | Griebat | B02B 5/02 241/11 |
| 7,138,527 | B2 | 11/2006 | Galli et al. | |
| 7,296,511 | B2 | 11/2007 | Koerda et al. | |
| 7,297,356 | B2 | 11/2007 | Macgregor et al. | |
| 7,459,174 | B2 * | 12/2008 | Rubio | A21D 8/042 426/18 |
| 7,524,522 | B2 | 4/2009 | Deline et al. | |
| 7,820,418 | B2 | 10/2010 | Karl et al. | |
| 7,938,345 | B2 | 5/2011 | Teeter, Jr. et al. | |
| 8,141,799 | B2 * | 3/2012 | Gehrig | C12C 1/02 241/13 |
| 8,851,408 | B2 | 10/2014 | Bihn | |
| 2004/0187863 | A1 * | 9/2004 | Langhauser | A23J 1/12 127/24 |
| 2005/0118693 | A1 | 6/2005 | Thorre | |
| 2007/0231437 | A1 | 10/2007 | Knight | |
| 2008/0318291 | A1 * | 12/2008 | Langhauser | A23J 1/12 435/162 |
| 2009/0098273 | A1 * | 4/2009 | Coste | A23L 1/1025 426/627 |
| 2009/0169683 | A1 * | 7/2009 | Findlay | A23L 1/1016 426/72 |
| 2009/0294558 | A1 | 12/2009 | Bihn | |
| 2010/0323062 | A1 * | 12/2010 | Southan | B02B 1/00 426/28 |
| 2014/0245799 | A1 * | 9/2014 | Kim | C05F 11/00 71/10 |
| 2014/0356513 | A1 * | 12/2014 | Wang | B02B 5/02 426/618 |

* cited by examiner

Incremental Crushing

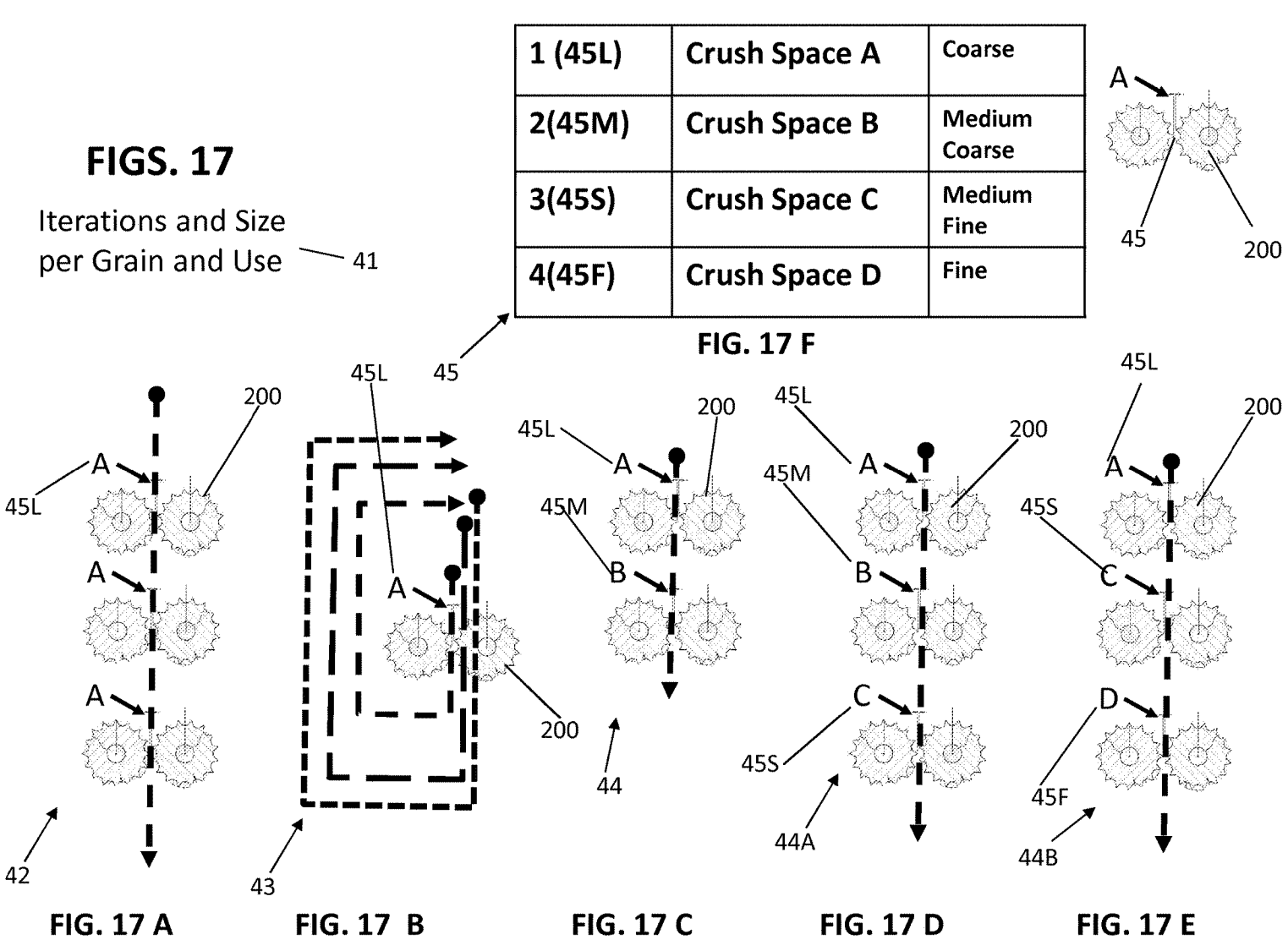
| | | |
|---|---|---|
| 1 (45L) | Crush Space A | Coarse |
| 2(45M) | Crush Space B | Medium Coarse |
| 3(45S) | Crush Space C | Medium Fine |
| 4(45F) | Crush Space D | Fine |

Examples of Equipment

Grain Basics
54

Wheat
Rye
Corn
Triticale
Barley
Sorghum
55

COMPONENTS OF THE CORN KERNEL
Endosperm
Pericarp
Germ
Tip Cap
50
51
52
53
BRAN = PERICARP + TIP CAP Pericarp
Endosperm
Germ
Tip Cap
Starch
Protein
Endosperm Fiber
Coarse Fiber
Oil
56

Crushing Graphics
57
58
58A
59
60

61

| US Sieve | Micron Size |
|---|---|
| 4 | 4760 |
| 6 | 3360 |
| 8 | 2380 |
| 12 | 1680 |
| 16 | 1190 |
| 20 | 840 |
| 30 | 590 |
| 40 | 420 |
| 50 | 297 |
| 70 | 210 |
| 100 | 149 |
| 140 | 105 |
| 200 | 74 |
| 270 | 53 |
| Pan | 37 |

FIG. 21 A

FIGS. 21 Milled Corn

FIGS. 21
Milled Corn continued

62

| US Sieve | Micron Size | Wt. grams | % |
|---|---|---|---|
| 4 | 4760 | 0.00 | 0.00 |
| 6 | 3360 | 0.10 | 0.10 |
| 8 | 2380 | 4.40 | 4.57 |
| 12 | 1680 | 16.00 | 16.61 |
| 16 | 1190 | 26.70 | 27.73 |
| 20 | 840 | 13.90 | 14.43 |
| 30 | 590 | 10.20 | 10.59 |
| 40 | 420 | 9.20 | 9.55 |
| 50 | 297 | 6.10 | 6.33 |
| 70 | 210 | 4.80 | 4.98 |
| 100 | 149 | 2.50 | 2.60 |
| 140 | 105 | 1.50 | 1.56 |
| 200 | 74 | 0.90 | 0.93 |
| 270 | 53 | 0.00 | 0.00 |
| Pan | 37 | 0.00 | 0.00 |
| Summation | | 96.30 | 100.00 |

| | |
|---|---|
| Particle Size Dgw. | 924 |
| Standard Dev., Sgw | 2015 |
| | |
| Surface Area (cm^2)/gram | 65.8 |
| Particles / Gram | 13,207 |
| | |
| Range | |
| Upper 1 stdev | 1983 |
| Lower 1 stdev | 431 |

FIG. 21 B

Milled Corn continued

| Crushed Corn | | | Crushed Corn<br>Corn-Horse<br>14905<br>Teamwork Manufacturing<br>C1<br>071013 (corn) | |
|---|---|---|---|---|
| Sample Number<br>Description of Feedstuff | | | AS IS BASIS | DRY BASIS |
| pH | | % | | |
| Moisture | | % | 11.53 | |
| Dry Matter | | % | 88.47 | |
| Fat | | % | 5.71 | 6.45 |
| Crude Protein | | % | 10.24 | 11.57 |
| Digestable Protein | | % | 7.06 | 7.98 |
| Fiber | | % | 2.60 | 2.94 |
| Ash | | % | 1.64 | 1.85 |
| NFE (Crude Carbohydrate) | | % | 68.28 | 77.19 |
| Digestable Carbohydrates | | % | 61.45 | 69.46 |
| TDN | | % | 79.85 | 90.26 |
| ENE | | Mcal/100lbs | 70.43 | 79.61 |
| NE (Gain) | | Mcal/lb | 0.58 | 0.66 |
| NE (Location) | | Mcal/lb | 0.84 | 0.95 |
| Digestable Energy | | Mcal/lb | 1.60 | 1.81 |
| Calcium | Ca | % | <0.050 | |
| Phophorus | P | % | 0.345 | 0.39 |
| Potassium | K | % | 0.384 | 0.434 |
| Magnesium | Mg | % | 0.127 | 0.144 |
| Sodium | Na | % | 0.009 | 0.01 |
| Sulfer | S | % | 0.106 | 0.12 |
| Iron | Fe | ppm | 27.0 | 30.5 |
| Manganese | Mn | ppm | 6.7 | 7.6 |
| Copper | Cu | ppm | 3.2 | 3.6 |
| Zinc | Zn | ppm | 27.2 | 30.7 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | <0.50 | |
| Molybdenum | ppm | | 0.59 | 0.67 |
| Selenium | ppm | | | |

70

FIG. 22 A

FIGS. 22 Crushed Corn

| Crushed Corn | | | Crushed Corn<br>Corn-Chicken<br>14906<br>Teamwork Manufacturing<br>C2<br>71013 | |
|---|---|---|---|---|
| Sample Number<br>Description of Feedstuff | | | AS IS BASIS | DRY BASIS |
| pH | | % | | |
| Moisture | | % | 11.98 | |
| Dry Matter | | % | 88.02 | |
| Fat | | % | 2.6 | 2.95 |
| Crude Protein | | % | 8.06 | 9.16 |
| Digestable Protein | | % | 6.28 | 7.13 |
| Fiber | | % | 1.41 | 1.60 |
| Ash | | % | 0.60 | 0.68 |
| NFE (Crude Carbohydrate) | | % | 75.35 | 85.61 |
| Digestable Carbohydrates | | % | 69.32 | 78.75 |
| TDN | | % | 80.28 | 91.21 |
| ENE | | Mcal/100lbs | 70.9 | 80.55 |
| NE (Gain) | | Mcal/lb | 0.59 | 0.67 |
| NE (Location) | | Mcal/lb | 0.84 | 0.96 |
| Digestable Energy | | Mcal/lb | 1.60 | 1.82 |
| Calcium | Ca | % | <0.050 | |
| Phophorus | P | % | 0.198 | 0.225 |
| Potassium | K | % | 0.235 | 0.267 |
| Magnesium | Mg | % | 0.067 | 0.076 |
| Sodium | Na | % | 0.002 | 0.002 |
| Sulfer | S | % | 0.095 | 0.108 |
| Iron | Fe | ppm | 16.6 | 18.9 |
| Manganese | Mn | ppm | 3.5 | 4.0 |
| Copper | Cu | ppm | 8.8 | 10.0 |
| Zinc | Zn | ppm | 18.6 | 21.1 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | <0.50 | |
| Molybdenum | ppm | | <0.50 | |
| Selenium | ppm | | | |

70

FIG. 22 B
FIGS. 22 Crushed Corn continued

| Crushed Corn - All Corn Meal | | | Crushed Corn Coarse Ba red Mill | |
|---|---|---|---|---|
| Sample Number | | | 14911 | |
| Description of Feedstuff | | | Teamwork Manufacturing B3 71013(corn) | |
| | | | AS IS BASIS | DRY BASIS |
| pH | | % | | |
| Moisture | | % | 11.23 | |
| Dry Matter | | % | 88.77 | |
| Fat | | % | 2.25 | 2.53 |
| Crude Protein | | % | 8.91 | 10.04 |
| Digestable Protein | | % | 6.15 | 6.93 |
| Fiber | | % | 1.75 | 1.97 |
| Ash | | % | 1.01 | 1.14 |
| NFE (Crude Carbohydrate) | | % | 74.85 | 84.32 |
| Digestable Carbohydrates | | % | 67.36 | 75.88 |
| TDN | | % | 78.09 | 87.97 |
| ENE | | Mcal/100lbs | 68.65 | 77.33 |
| NE (Gain) | | Mcal/lb | 0.57 | 0.64 |
| NE (Location) | | Mcal/lb | 0.83 | 0.93 |
| Digestable Energy | | Mcal/lb | 1.56 | 1.76 |
| Calcium | Ca | % | < 0.050 | |
| Phophorus | P | % | 0.225 | 0.253 |
| Potassium | K | % | 0.298 | 0.291 |
| Magnesium | Mg | % | 0.079 | 0.089 |
| Sodium | Na | % | 0.002 | 0.002 |
| Sulfer | S | % | | |
| Iron | Fe | ppm | 16.4 | 18.5 |
| Manganese | Mn | ppm | 3.5 | 3.9 |
| Copper | Cu | ppm | 1.4 | 1.6 |
| Zinc | Zn | ppm | 14.2 | 16.0 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

71

FIG. 23 A

FIGS. 23 More Crushed Corn

| Crushed Corn - All Corn Meal | | | Crushed Corn | |
|---|---|---|---|---|
| | | | Fine Red Mill | |
| Sample Number | | | 14912 | |
| Description of Feedstuff | | | Teamwork Manufacturing | |
| | | | B4 | |
| | | | 71013 | |
| | | | AS IS BASIS | DRY BASIS |
| pH | | % | | |
| Moisture | | % | 11.96 | |
| Dry Matter | | % | 88.04 | |
| Fat | | % | 2.8 | 3.18 |
| Crude Protein | | % | 8.10 | 9.20 |
| Digestable Protein | | % | 5.59 | 6.35 |
| Fiber | | % | 1.75 | 1.99 |
| Ash | | % | 1.16 | 1.32 |
| NFE (Crude Carbohydrate) | | % | 74.23 | 84.31 |
| Digestable Carbohydrates | | % | 66.81 | 75.89 |
| TDN | | % | 78.03 | 88.63 |
| ENE | | Mcal/100lbs | 68.66 | 77.99 |
| NE (Gain) | | Mcal/lb | 0.57 | 0.65 |
| NE (Location) | | Mcal/lb | 0.82 | 0.93 |
| Digestable Energy | | Mcal/lb | 1.56 | 1.77 |
| Calcium | Ca | % | <0.050 | |
| Phophorus | P | % | 0.255 | 0.290 |
| Potassium | K | % | 0.301 | 0.342 |
| Magnesium | Mg | % | 0.083 | 0.094 |
| Sodium | Na | % | < 0.001 | |
| Sulfer | S | % | | |
| Iron | Fe | ppm | 14.5 | 16.5 |
| Manganese | Mn | ppm | 3.8 | 4.3 |
| Copper | Cu | ppm | 1.1 | 1.2 |
| Zinc | Zn | ppm | 16.4 | 18.6 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

71

FIG. 23 B

FIGS. 23 More Crushed Corn continued

| Crushed Corn - All Corn Meal | | | Crushed Corn Coarse Meal | |
|---|---|---|---|---|
| Sample Number | | | 14913 | |
| Description of Feedstuff | | | Teamwork Manufacturing C3 71013 | |
| | | | AS IS BASIS | DRY BASIS |
| pH | | % | | |
| Moisture | | % | | |
| Dry Matter | | % | | |
| Fat | | % | 2.51 | 2.87 |
| Crude Protein | | % | 7.31 | 8.35 |
| Digestable Protein | | % | 5.04 | 5.76 |
| Fiber | | % | 1.15 | 1.31 |
| Ash | | % | 0.48 | 0.55 |
| NFE (Crude Carbohydrate) | | % | 76.06 | 86.92 |
| Digestable Carbohydrates | | % | 68.45 | 78.22 |
| TDN | | % | 78.47 | 89.637 |
| ENE | | Mcal/100lbs | 69.14 | 79.01 |
| NE (Gain) | | Mcal/lb | 0.58 | 0.66 |
| NE (Location) | | Mcal/lb | 0.82 | 0.94 |
| Digestable Energy | | Mcal/lb | 1.57 | 1.79 |
| Calcium | Ca | % | <0.050 | |
| Phophorus | P | % | 0.208 | 0.238 |
| Potassium | K | % | 0.248 | 0.283 |
| Magnesium | Mg | % | 0.073 | 0.083 |
| Sodium | Na | % | < 0.001 | |
| Sulfer | S | % | | |
| Iron | Fe | ppm | 22.6 | 25.8 |
| Manganese | Mn | ppm | 4.2 | 4.8 |
| Copper | Cu | ppm | 38.2 | 43.7 |
| Zinc | Zn | ppm | 32.6 | 37.3 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

71

FIG. 23 C

FIGS. 23 More Crushed Corn continued

| Crushed Corn - All Corn Meal | | | Crushed Corn | |
|---|---|---|---|---|
| | | | Fine Flour | |
| Sample Number | | | 14914 | |
| Description of Feedstuff | | | Teamwork Manufacturing | |
| | | | C4 | |
| | | | 71013 | |
| | | | AS IS BASIS | DRY BASIS |
| pH | | % | | |
| Moisture | | % | 13.69 | |
| Dry Matter | | % | 86.31 | |
| Fat | | % | 1.45 | 1.68 |
| Crude Protein | | % | 5.69 | 6.59 |
| Digestable Protein | | % | 3.92 | 4.54 |
| Fiber | | % | 0.90 | 1.04 |
| Ash | | % | 0.16 | 0.19 |
| NFE (Crude Carbohydrate) | | % | 78.11 | 90.5 |
| Digestable Carbohydrates | | % | 70.3 | 81.45 |
| TDN | | % | 77.14 | 89.38 |
| ENE | | Mcal/100lbs | 67.9 | 78.67 |
| NE (Gain) | | Mcal/lb | 0.57 | 0.66 |
| NE (Location) | | Mcal/lb | 0.81 | 0.94 |
| Digestable Energy | | Mcal/lb | 1.54 | 1.79 |
| Calcium | Ca | % | <0.050 | |
| Phophorus | P | % | 0.113 | 0.131 |
| Potassium | K | % | 0.160 | 0.185 |
| Magnesium | Mg | % | 0.039 | 0.045 |
| Sodium | Na | % | | <0.001 |
| Sulfer | S | % | | |
| Iron | Fe | ppm | 35.0 | 40.6 |
| Manganese | Mn | ppm | 2.8 | 3.2 |
| Copper | Cu | ppm | 65.9 | 76.4 |
| Zinc | Zn | ppm | 35.9 | 41.6 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

71

FIG. 23 D

FIGS. 23 More Crushed Corn continued

| Crushed Wheat - Crushed and Seived | | | Crushed Wheat | |
|---|---|---|---|---|
| | | | Wheat-Chicken | |
| Sample Number | | | 14907 | |
| Description of Feedstuff | | | Teamwork Manufacturing | |
| | | | A1 | |
| | | | 071013 (wheat) | |
| | | | AS IS BASIS | DRY BASIS |
| pH | | % | | |
| Moisture | | % | 10.66 | |
| Dry Matter | | % | 89.34 | |
| Fat | | % | 1.60 | 1.79 |
| Crude Protein | | % | 9.45 | 10.58 |
| Digestable Protein | | % | 7.37 | 8.25 |
| Fiber | | % | 2.76 | 3.09 |
| Ash | | % | 1.78 | 1.96 |
| NFE (Crude Carbohydrate) | | % | 73.78 | 82.58 |
| Digestable Carbohydrates | | % | 67.88 | 75.98 |
| TDN | | % | 78.75 | 88.15 |
| ENE | | Mcal/100lbs | 69.26 | 77.52 |
| NE (Gain) | | Mcal/lb | 0.57 | 0.64 |
| NE (Location) | | Mcal/lb | 0.83 | 0.93 |
| Digestable Energy | | Mcal/lb | 1.57 | 1.76 |
| Calcium | Ca | % | < 0.050 | |
| Phophorus | P | % | 0.322 | 0.360 |
| Potassium | K | % | 0.395 | 0.442 |
| Magnesium | Mg | % | 0.109 | 0.122 |
| Sodium | Na | % | 0.001 | 0.001 |
| Sulfer | S | % | 0.123 | 0.138 |
| Iron | Fe | ppm | 32.2 | 34.9 |
| Manganese | Mn | ppm | 28.4 | 31.8 |
| Copper | Cu | ppm | 3.9 | 4.4 |
| Zinc | Zn | ppm | 24.2 | 27.1 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | <0.50 | |
| Molybdenum | ppm | | 3.89 | 2.12 |
| Selenium | ppm | | | |

72

FIG. 24 A

FIGS. 24 Crushed Wheat

| Crushed Wheat - Crushed and Seived | | | Crushed Wheat | |
|---|---|---|---|---|
| | | | Wheat- Meal | |
| Sample Number | | | 14908 | |
| Description of Feedstuff | | | Teamwork Manufacturing | |
| | | | A2 | |
| | | | 71013 | |
| | | | AS IS BASIS | DRY BASIS |
| pH | | % | | |
| Moisture | | % | 10.80 | |
| Dry Matter | | % | 89.20 | |
| Fat | | % | 2.30 | 2.58 |
| Crude Protein | | % | 9.20 | 10.31 |
| Digestable Protein | | % | 7.17 | 8.04 |
| Fiber | | % | 1.70 | 1.91 |
| Ash | | % | 1.69 | 1.89 |
| NFE (Crude Carbohydrate) | | % | 74.31 | 83.31 |
| Digestable Carbohydrates | | % | 68.37 | 76.65 |
| TDN | | % | 79.83 | 89.50 |
| ENE | | Mcal/100lbs | 70.35 | 78.87 |
| NE (Gain) | | Mcal/lb | 0.59 | 0.66 |
| NE (Location) | | Mcal/lb | 0.84 | 0.94 |
| Digestable Energy | | Mcal/lb | 1.60 | 1.79 |
| Calcium | Ca | % | <0.050 | |
| Phophorus | P | % | 0.371 | 0.416 |
| Potassium | K | % | 0.428 | 0.48 |
| Magnesium | Mg | % | 0.123 | 0.138 |
| Sodium | Na | % | <0.001 | |
| Sulfer | S | % | 0.121 | 0.136 |
| Iron | Fe | ppm | 39.6 | 44.4 |
| Manganese | Mn | ppm | 33.4 | 37.4 |
| Copper | Cu | ppm | 5.0 | 5.6 |
| Zinc | Zn | ppm | 32.5 | 36.4 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | <0.50 | |
| Molybdenum | ppm | | 1.80 | 2.02 |
| Selenium | ppm | | | |

72

FIG. 24 B

FIGS. 24 Crushed Wheat continued

| Crushed Wheat - Crushed and Seived | | | Crushed Wheat | |
|---|---|---|---|---|
| | | | Wheat -Flour | |
| Sample Number | | | 14909 | |
| Description of Feedstuff | | | Teamwork Manufacturing | |
| | | | A3 | |
| | | | 071013 (wheat) | |
| | | | AS IS BASIS | DRY BASIS |
| pH | | % | | |
| Moisture | | % | 11.98 | |
| Dry Matter | | % | 88.02 | |
| Fat | | % | 3.75 | 4.26 |
| Crude Protein | | % | 7.36 | 8.36 |
| Digestable Protein | | % | 5.74 | 6.52 |
| Fiber | | % | 2.76 | 3.14 |
| Ash | | % | 1.66 | 1.20 |
| NFE (Crude Carbohydrate) | | % | 73.09 | 83.04 |
| Digestable Carbohydrates | | % | 67.24 | 76.39 |
| TDN | | % | 79.97 | 90.85 |
| ENE | | Mcal/100lbs | 70.59 | 80.20 |
| NE (Gain) | | Mcal/lb | 0.59 | 0.67 |
| NE (Location) | | Mcal/lb | 0.64 | 0.96 |
| Digestable Energy | | Mcal/lb | 1.60 | 1.82 |
| Calcium | Ca | % | <0.050 | |
| Phophorus | P | % | 0.222 | 0.252 |
| Potassium | K | % | 0.272 | 0.309 |
| Magnesium | Mg | % | 0.074 | 0.084 |
| Sodium | Na | % | <0.001 | |
| Sulfer | S | % | | |
| Iron | Fe | ppm | 25.0 | 28.4 |
| Manganese | Mn | ppm | 11.0 | 12.5 |
| Copper | Cu | ppm | 10.2 | 11.6 |
| Zinc | Zn | ppm | 20.9 | 23.7 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | | |
| Molybdenum | ppm | | | |

72

FIG. 24 C

FIGS. 24 Crushed Wheat continued

| Wheat - Crushed and Seived | | | Crushed Wheat | |
|---|---|---|---|---|
| | | | Wheat -Flour | |
| Sample Number | | | 14910 | |
| Description of Feedstuff | | | Teamwork Manufacturing | |
| | | | A4 | |
| | | | 71013 | |
| | | | AS IS BASIS | DRY BASIS |
| pH | | % | | |
| Moisture | | % | 11.58 | |
| Dry Matter | | % | 88.42 | |
| Fat | | % | 0.90 | 1.02 |
| Crude Protein | | % | 6.57 | 7.43 |
| Digestable Protein | | % | 5.12 | 5.79 |
| Fiber | | % | 2.70 | 3.05 |
| Ash | | % | 0.49 | 0.55 |
| NFE (Crude Carbohydrate) | | % | 77.76 | 87.95 |
| Digestable Carbohydrates | | % | 71.54 | 80.91 |
| TDN | | % | 79.01 | 89.36 |
| ENE | | Mcal/100lbs | 69.60 | 78.72 |
| NE (Gain) | | Mcal/lb | 0.58 | 0.66 |
| NE (Location) | | Mcal/lb | 0.83 | 0.94 |
| Digestable Energy | | Mcal/lb | 1.58 | 1.79 |
| Calcium | Ca | % | <0.050 | |
| Phophorus | P | % | 0.105 | 0.119 |
| Potassium | K | % | 0.153 | 0.173 |
| Magnesium | Mg | % | 0.025 | 0.028 |
| Sodium | Na | % | 0.002 | 0.002 |
| Sulfer | S | % | | |
| Iron | Fe | ppm | 29.9 | 33.8 |
| Manganese | Mn | ppm | 7.2 | 8.1 |
| Copper | Cu | ppm | 9.9 | 11.2 |
| Zinc | Zn | ppm | 15.3 | 17.3 |
| Water-Soluable Nitrogen (NO2) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |
| Cobalt | ppm | | | |
| Molybdenum | ppm | | | |
| Selenium | ppm | | | |

72

FIG. 24 D

FIGS. 24 Crushed Wheat continued

| Crushed Corn and Wheat | | | Crushed Corn and Wheat | |
|---|---|---|---|---|
| | | | Wheat - No Seive | |
| Sample Number | | | 14915 | |
| Description of Feedstuff | | | Teamwork Manufacturing | |
| | | | D99 | |
| | | | 071013 (wheat) | |
| | | | AS IS BASIS | DRY BASIS |
| pH | | % | | |
| Moisture | | % | 10.04 | |
| Dry Matter | | % | 89.96 | |
| Fat | | % | 1.95 | 2.17 |
| Crude Protein | | % | 10.49 | 11.66 |
| Digestable Protein | | % | 8.18 | 9.09 |
| Fiber | | % | 2.31 | 2.57 |
| Ash | | % | 1.42 | 1.58 |
| NFE (Crude Carbohydrate) | | % | 73.79 | 82.02 |
| Digestable Carbohydrates | | % | 67.89 | 75.47 |
| TDN | | % | 79.99 | 88.92 |
| ENE | | Mcal/100lbs | 70.45 | 78.31 |
| NE (Gain) | | Mcal/lb | 0.58 | 0.65 |
| NE (Location) | | Mcal/lb | 0.85 | 0.94 |
| Digestable Energy | | Mcal/lb | 1.6 | 1.78 |
| Calcium | Ca | % | <0.050 | |
| Phophorus | P | % | 0.447 | 0.497 |
| Potassium | K | % | 0.418 | 0.465 |
| Magnesium | Mg | % | 0.132 | 0.147 |
| Sodium | Na | % | 0.005 | 0.006 |
| Sulfer | S | % | | |
| Iron | Fe | ppm | 37.8 | 42 |
| Manganese | Mn | ppm | 46.2 | 51.4 |
| Copper | Cu | ppm | 50.7 | 56.4 |
| Zinc | Zn | ppm | 46.1 | 51.2 |
| Water-Soluable Nitrogen ($NO_3$) | | % | | |
| Ammonia ($NH4$ ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

73

FIG. 25 A

FIGS. 25 Crushed Corn and Wheat

| Crushed Corn and Wheat | | | Crushed Corn and Wheat | |
|---|---|---|---|---|
| | | | Corn - Crusher/No Seive | |
| Sample Number | | | 14916 | |
| Description of Feedstuff | | | Teamwork Manufacturing | |
| | | | E99 | |
| | | | 071013 (corn) | |
| | | | AS IS BASIS | DRY BASIS |
| pH | | % | | |
| Moisture | | % | 11.25 | |
| Dry Matter | | % | 88.75 | |
| Fat | | % | 3.41 | 3.84 |
| Crude Protein | | % | 7.89 | 8.89 |
| Digestable Protein | | % | 5.44 | 6.13 |
| Fiber | | % | 1.65 | 1.86 |
| Ash | | % | 0.87 | 0.98 |
| NFE (Crude Carbohydrate) | | % | 74.93 | 84.43 |
| Digestable Carbohydrates | | % | 67.44 | 75.99 |
| TDN | | % | 79.67 | 89.77 |
| ENE | | Mcal/100lbs | 70.23 | 79.13 |
| NE (Gain) | | Mcal/lb | 0.59 | 0.66 |
| NE (Location) | | Mcal/lb | 0.84 | 0.95 |
| Digestable Energy | | Mcal/lb | 1.6 | 1.8 |
| Calcium | Ca | % | <0.050 | |
| Phophorus | P | % | 0.249 | 0.281 |
| Potassium | K | % | 0.264 | 0.297 |
| Magnesium | Mg | % | 0.084 | 0.095 |
| Sodium | Na | % | <0.001 | |
| Sulfer | S | % | | |
| Iron | Fe | ppm | 37.3 | 42 |
| Manganese | Mn | ppm | 4.7 | 5.3 |
| Copper | Cu | ppm | 79.8 | 89.9 |
| Zinc | Zn | ppm | 18.9 | 21.3 |
| Water-Soluable Nitrogen ($NO_2$) | | % | | |
| Ammonia (NH4 ) | | % | | |
| Neutral Detergent Fiber | | % | | |
| Acid Detergent Fiber | | | | |
| Unavailable Crude Protein (ADF-Protein) | | % | | |
| Relative Feed Valve | | | | |

FIG. 25 B

73

FIGS. 25 Crushed Corn and Wheat continued

Purdue/Missouri Confirmations

Sender: Brian Richert Date:12/24/2013
Company: Purdue University, Animal Science Department

| ESCL # | 20389 | 20390 | 20391 | 20392 |
|---|---|---|---|---|
| Units | W/W% | W/W% | W/W% | W/W% |
| Dept # | Sample 1 | Sample 2 | Sample 3 | Sample 4 |
| Sample | Cracked Corn | Pig Feed | R4+42T | R5+145T |
| Description | Coarse | Medium Coarse | Medium Fine | Fine |
| Taurine | 0.07 | 0.04 | 0.05 | 0.05 |
| Hydroxyproline | 0.04 | 0.02 | 0.02 | 0.01 |
| Aspartic Acid | 0.65 | 0.53 | 0.48 | 0.33 |
| Threonine | 0.34 | 0.29 | 0.25 | 0.18 |
| Serine | 0.44 | 0.4 | 0.34 | 0.23 |
| Glumatic Acid | 1.72 | 1.61 | 1.33 | 0.88 |
| Proline | 0.83 | 0.76 | 0.66 | 0.45 |
| Lanthionine | 0.00 | 0.00 | 0.00 | 0.00 |
| Glycine | 0.39 | 0.28 | 0.28 | 0.20 |
| Alanine | 0.72 | 0.64 | 0.54 | 0.35 |
| Cystine | 0.18 | 0.17 | 0.16 | 0.11 |
| Valine | 0.45 | 0.38 | 0.34 | 0.25 |
| Methionine | 0.18 | 0.18 | 0.16 | 0.10 |
| Isoleucine | 0.34 | 0.31 | 0.26 | 0.18 |
| Leucine | 1.17 | 1.15 | 0.9 | 0.58 |
| Tyrosine | 0.29 | 0.27 | 0.21 | 0.08 |
| Phenylalanine | 0.48 | 0.45 | 0.36 | 0.24 |
| Hydroxylysine | 0.04 | 0.02 | 0.02 | 0.01 |
| Ornithine | 0.00 | 0.00 | 0.00 | 0.00 |
| Lysine | 0.35 | 0.23 | 0.23 | 0.16 |
| Histidine | 0.28 | 0.24 | 0.22 | 0.16 |
| Arginine | 0.46 | 0.32 | 0.31 | 0.19 |
| Tryptophan | 0.06 | 0.05 | 0.04 | 0.04 |
| Total | 9.48 | 8.34 | 7.16 | 4.78 |
| Crude Protein | 9.83 | 8.06 | 6.98 | 5.08 |

* Percentage N x 6.25. W/W% = grams per 100 grams of sample.
Results are expressed as an "as is" basis unless otherwise indicated.

77

FIG. 26 A

FIGS. 26 Purdue/ Missouri Confirmations

Purdue/Missouri Confirmations

Sender: Brian Richert Date:12/24/2013
Company: Purdue University, Animal Science Department

| ESCL # | 20389 | 20390 | 20391 | 20392 |
|---|---|---|---|---|
| Units | W/W% | W/W% | W/W% | W/W% |
| Dept # | Sample 1 | Sample 2 | Sample 3 | Sample 4 |
| Sample | Cracked Corn | Pig Feed | R4+42T | R5+145T |
| Description | Coarse | Medium Coarse | Medium Fine | Fine |

| ESCL # | 20389 | 20390 | 20391 | 20392 |
|---|---|---|---|---|
| Units | W/W% | W/W% | W/W% | W/W% |
| Dept # | Sample 1 | Sample 2 | Sample 3 | Sample 4 |
| Sample | Cracked Corn | Pig Feed | R4+42T | R5+145T |
| Description | Coarse | Medium Coarse | Medium Fine | Fine |
| Moisture | 12.78 | 13.37 | 12.63 | 13.105 |
| Crude Fat | 3.15 | 0.00 | 0.54 | 0.00 |
| Crude Fiber | 2.8 | 1.79 | 1.29 | 0.99 |
| Ash | 1.56 | 0.74 | 0.83 | 0.57 |
| Calcium | <0.6 | <0.6 | <0.6 | <0.6 |
| Phosphorus | 0.41 | 0.15 | 0.2 | 0.13 |
| Potassium | 0.37 | 0.16 | 0.19 | 0.14 |
| Starch | 64.47 | 75.57 | 71.13 | 80.68 |

W/W% = grams per 100 grams of sample.
Results are expressed as an "as is" basis unless otherwise indicated.

77

FIG. 26 B

FIGS. 26 Purdue/ Missouri Confirmations continued

FIGS. 27
Comparison – Crushed & Sieve vs Milled Corn
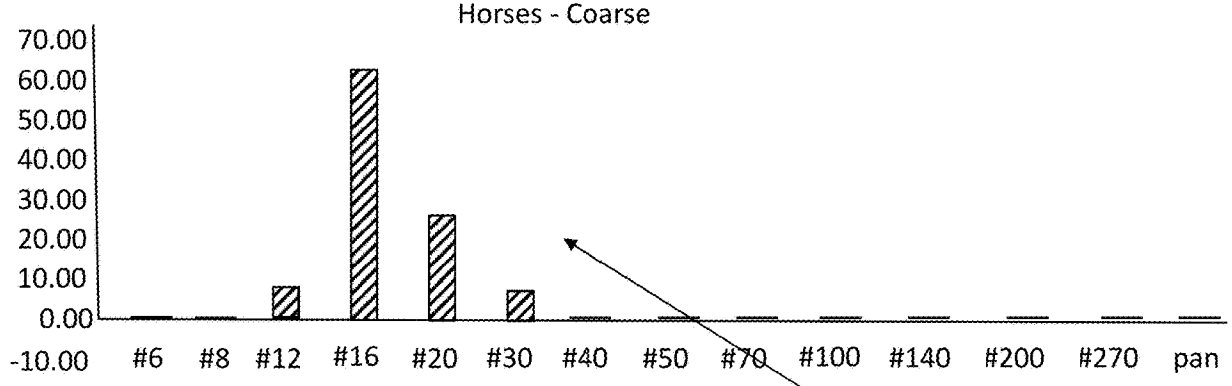
FIG. 27 A
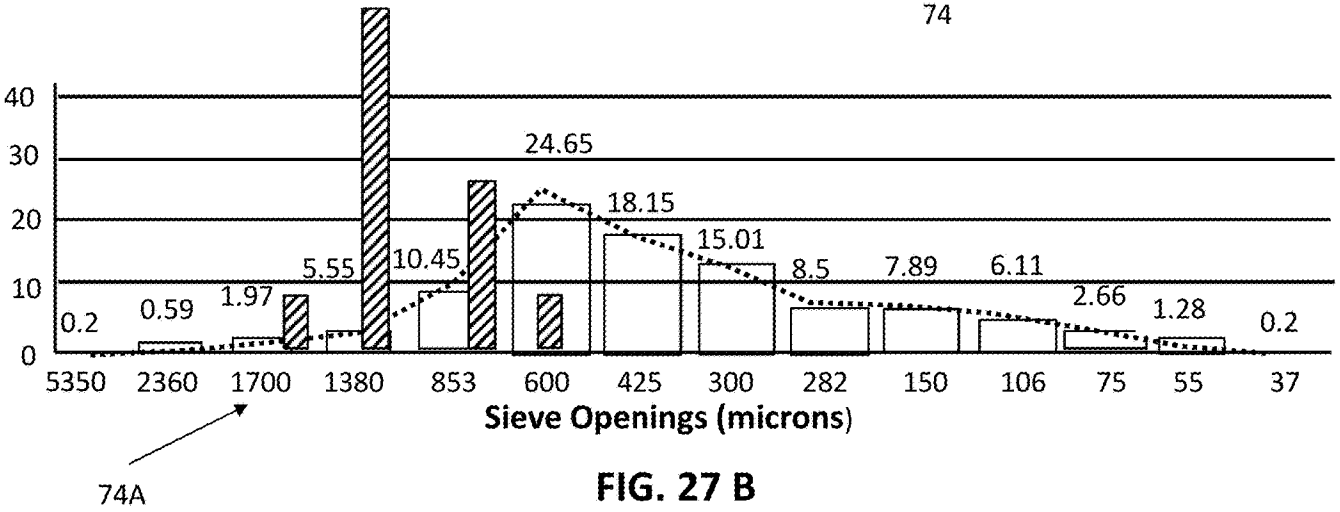
FIG. 27 B FIGS. 27
Comparison – Crushed & Sieve vs Milled Corn continued
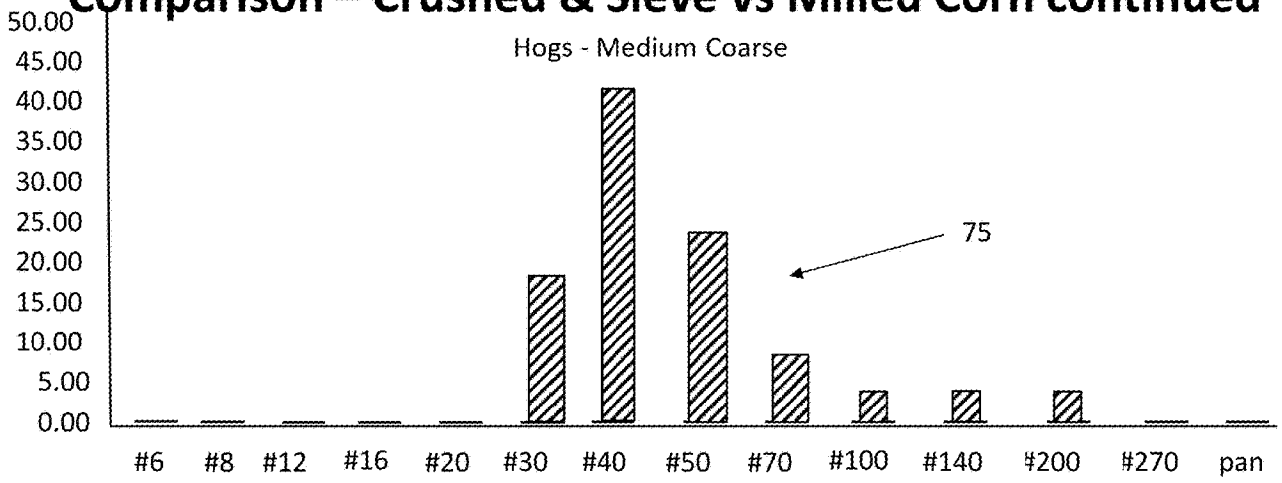
FIG. 27 C
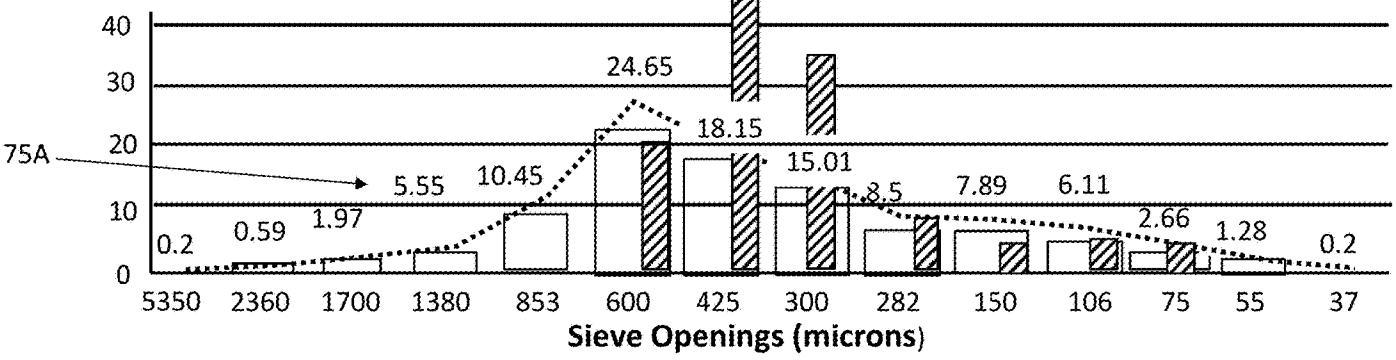
FIG. 27 D

FIGS. 27
Comparison – Crushed & Sieve vs Milled Corn continued
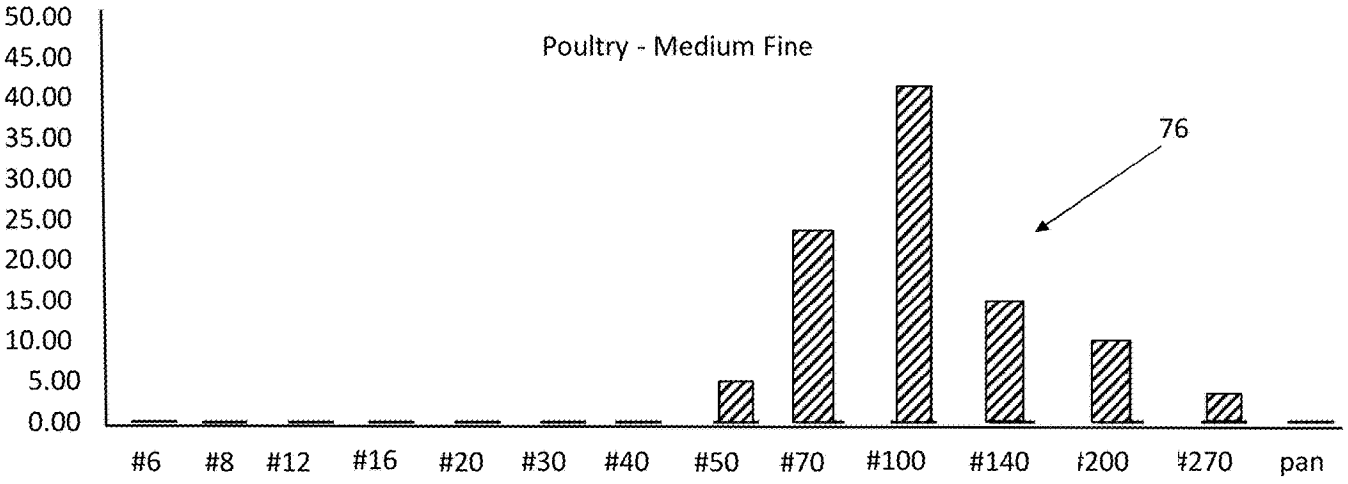
FIG. 27 E
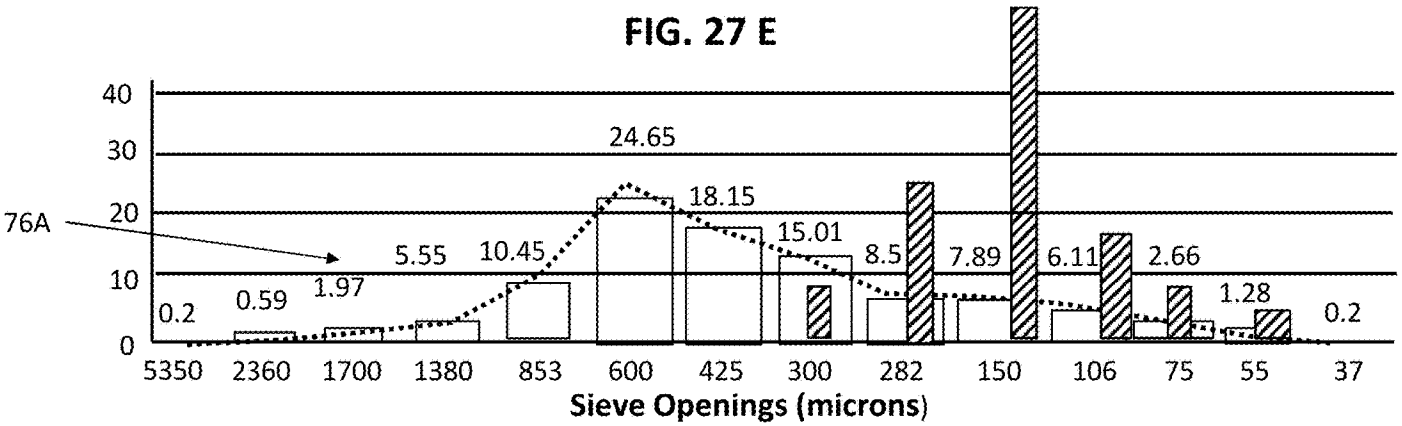
FIG. 27 F

GRAIN CRUSHING APPARATUSES AND PROCESSES

CROSS-REFERENCE TO RELATED APPLICATIONS

This application is a Continuation-in-Part [CIP] filed under 37 CFR 1.53(b) and claims the benefit of the original, non-provisional Parent (Regular Utility) U.S. patent application Ser. No. 13/558,938 submitted Jul. 26, 2012 and Published Jan. 31, 2013 as US 2013/0026273 A1. The original Parent application was active on the date of the submission of this CIP. The parent application was allowed and issued as U.S. Pat. No. 8,851,408 on Oct. 7, 2014. The original application and publication are both entitled a "Grain Crushing Apparatuses" and both were submitted by John Bihn. This application also claims the benefit of Provisional Patent Application Ser. No. 61/935,941 filed Feb. 5, 2014 by John Bihn and entitled "Special grain crushing process".

FIELD OF INVENTION

The present invention is generally directed to agriculture-related apparatuses and related processes, and, more particularly, to grain processing apparatuses and processes.

FEDERALLY SPONSORED RESEARCH

None.

SEQUENCE LISTING OR PROGRAM

None.

BACKGROUND-FIELD OF INVENTION AND PRIOR ART

Background

As far as known, there are no special grain crushing apparatuses, processes or the like compared with the apparatuses and processes presented here. It is believed that these are unique in their design and technologies. Generally, grains are processed after harvesting to convert the grains into a form that may be consumed by humans, livestock, and the like. Processing the grain generally involves breaking the individual grains into smaller particles that are more easily consumed in the digestive tract of animals. Various processes that may be carried out on harvested grains include crimping, wilting, chopping, grinding, crushing and the like. A process, such as micro-crushing, involves breaking the grains into smaller particles and clumps that are easily consumable by humans, livestock, and the like.

Various techniques exist for breaking the grains into smaller particles. One such technique utilizes a pair of rollers in which a roller (hereinafter referred to as drive roller) of the pair of rollers is placed beside another roller (hereinafter referred to as driven roller) of the pair of rollers. The pair of rollers is operably coupled to each other via a shaft. The drive roller and the driven roller are co-axial with respect to the shaft. The shaft is configured on an axis that passes through center portions of the pair of rollers. The drive roller is composed of a cavity that is disposed around the shaft. The cavity is configured to receive the grains for crushing. The driven roller is fixed at a position while the drive roller is capable of being rotated about the axis. A lever configured on the drive roller assists a user in rotating the drive roller about the axis, with the driven roller fixed at the position. As the drive roller is rotated along the axis, the grain in the cavity is crushed into smaller pieces due to a force of friction between the pair of rollers.

However, milling the grains by using the technique explained above is associated with a few drawbacks. The force of friction that exists between the top roller and the bottom roller increases wear and tear of the pair of rollers. The wear and tear of the pair of rollers creates metal dust that may mix with the particles obtained from crushing the grains, making the particles unsuitable for consumption. Further, the particles obtained from crushing the grains may be of varying sizes, and, such particles of varying sizes may not be suitable for consumption by humans, livestock, and the like. Particularly, the grains may be milled to very fine particles such as grain dust that may be unsuitable for consumption. Further, sometimes, this technique may need to be repeated more than once to get a required size of the particles. Thus, this technique may require a lot of time and manual power to crush the grains into the smaller particles. Another known problem with processing grains by milling is the cutting and rupturing of the germ bag or pouch (sack). Once cut, the oils of the pouch are released and are beginning the breakdown process . . . and, if the grain is not used soon after, rancidity may be problematic.

Problem Solved

Based on the above mentioned drawbacks, there is a need for a process for crushing grains into substantially uniform-sized particles. Further, there is a need for a uniform method that crushes grains. Furthermore, there is need for reducing grain dust. Moreover, there is need for reducing manual power and time required for crushing grains.

PRIOR ART

Other processes have been provided that represent crushing methods. However they all fail to provide incremental crushing that protects the germ pouch from cutting or disturbance that eventually leads to a rancid decay of the crushed grain after the process. These inventions include:

| Ref. No. | Patent No. or Pub. No. | Inventor | Title | Date |
|---|---|---|---|---|
| 1 | 2,202,892 | Berry et al | Cereal Grinding Mill | Jun. 4, 1940 |
| 2 | 2,282,718 | Fujioka | Rice Hulling Machine | May 12, 1942 |
| 3 | 3,208,677 | Hesse | Grain Roller Mill | Sep. 28, 1965 |
| 4 | 3,548,742 | Korntal | Apparatus for continuously processing pulverulent or granular feeds | Dec. 22, 1970 |
| 5 | 3,633,831 | Marengo | Granulator Device and Helical shaped Cutters therefor | Jan. 11, 1972 |
| 6 | 4,196,224 | Falk | Method and apparatus for husking and drying cereal and legume kernels | Apr. 1, 1980 |
| 7 | 4,608,007 | Wood | Oat Crimper | Aug. 26, 1986 |
| 8 | 4,716,218 | Chen et al | Gain Extraction Milling | Dec. 29, 1987 |

-continued

| Ref. No. | Patent No. or Pub. No. | Inventor | Title | Date |
|---|---|---|---|---|
| 9 | 5,580,006 | Hennenfent et al | Sprocket Crusher | Dec. 3, 1996 |
| 10 | 5,816,511 | Bernardi et al | Cylinder type machine for milling seed | Oct. 6, 1998 |
| 11 | 6,398,036 | Griebat, et al. | Corn Milling and separating device and method | Jun. 4, 2002 |
| 12 | 6,506,423 | Drouillard et al. | Method of manufacturing a ruminant feedstuff with reduced ruminal protein degradability | Jan. 14, 2003 |
| 13 | 6,685,118 | Williams, Jr. | Two roll crusher and method of roller adjustment | Feb. 3, 2004 |
| 14 | 6,899,910 | Johnston, et al. | Processes for recovery of corn germ pouch/clump of cells and optionally corn coarse fiber (pericarp) | May 31, 2005 |
| 15 | US 2005/0118693 | Thorre | Process for fractionating seeds of cereal grains | Jun. 2, 2005 |
| 16 | 7,138,257 | Galli, et al. | Method for producing ethanol by using corn flours | Nov. 21, 2006 |
| 17 | US 2007/0231437 | Knight | Dry Milling process for the production of ethanol and feed with highly digestible protein | Oct. 4, 2007 |
| 18 | 7,296,511 | Koreda et al. | Rice hulling roll driving apparatus in rice huller | Nov. 20, 2007 |
| 19 | 7,297,356 | Macgregor, et al. | Method for manufacturing animal feed, method for increasing the rumen bypass capability of an animal feedstuff and animal feed | Nov. 20, 2007 |
| 20 | 7,524,522 | DeLine et al. | Kernel fractionation system | Apr. 28, 2009 |
| 21 | US 2009/0294558 | Bihn | Apparatus for crushing grains and method thereof | Dec. 3, 2009 |
| 22 | 7,820,418 | Karl et al. | Corn fractionation method | Oct. 26, 2010 |
| 23 | 7,938,345 | Teeter Jr. et al. | Dry milling corn fractionation process | May 10, 2011 |
| 24 | US 2011/0123657 | Vandenbroucke e al. | Method for obtaining highly purified and intact soybean hypocotyls | May 26, 2011 |
| 25 | 8,104,400 | Koreda et al/ | Husk roll driving device in hull remover | Jan. 31, 2012 |
| 26 | 8,227,012 | DeLine et al. | Grain fraction extraction material production system | Jul. 24, 2012 |
| 27 | US 2012/0312905 | Claycamp | Grain fraction endosperm recovery system | Dec. 13, 2012 |
| 28 | 2013/0026273 | Bihn | Grain crushing apparatuses | Jan. 31, 2013 |
| 29 | 8,551,553 | DeLine et al. | Grain endosperm extraction system | Oct. 8, 2013 |

None of these above referenced patents and publications anticipate or render obvious the current process shown herein.

SUMMARY OF THE INVENTION

This invention is a special grain crushing process. Taught here are the ways of addressing and processing grains such that they are crushed with a controlled process such that the germ bags or pouches/clump of cells are not disturbed or cut and such that the resultant product is secured so that decay and rancidity does not happen. Hence the shelf life of the crushed grain is significantly increased. The special grain crushing process is a controlled Micro-size Crushing of the grain. This is a method that will process grain effectively and efficiently. Particle size can be controlled to meet needs of customers to do a specific job. By controlling the micron size all good value in feed will be used in the digestion process. There will be little or no waste of food, better feed conversions, less toxins emitted from wastes and more profit for feed lot operations. The special grain crushing process is able to produce whole grain flours; there will be no reason to take out the germ (wheat) which will eliminate rancidity problems. There will be no loss of bran. This wheat (flour) is considered to be the "Staff of Life" having better nutrients and allowing people to get back to eating more healthy foods. This flour can also be stored for extended periods of time.

In one embodiment, a grain crushing apparatus includes a first sidewall and a second sidewall spaced apart from one another a throat dimension in a first direction, and a first support shaft and a second support shaft positioned transverse to the first sidewall and the second sidewall. The first support shaft and the second support shaft are each configured to rotate about an axis of rotation and are positioned a spacing distance from one another in a second direction normal to the first direction. The grain crushing apparatus also includes a first grain crushing roller and a second grain crushing roller. Each of the grain crushing rollers include a plurality of teeth extending from a root a tooth height. The first grain crushing roller is coupled to the first support shaft and the second grain crushing roller is coupled to the second support shaft. The first grain crushing roller and the second grain crushing roller are intermeshed with one another such the first grain crushing roller and the second grain crushing roller are maintained at positions spaced apart from one another in the second direction by an overlap distance less than the tooth height.

In another embodiment, a grain crushing apparatus includes a mill body having a first sidewall and a second sidewall spaced apart from one another a throat dimension in a first direction, where at least one of the first sidewall or the second sidewall includes a clearance opening. The grain crushing apparatus also includes a roller carrier assembly that is selectively extendible from the clearance opening in the mill body. The roller carrier assembly includes a first mount plate and a second mount plate spaced apart from one another in the first direction, a first support shaft and a second support shaft positioned transverse to the first mount plate and the second mount plate. The first support shaft and the second support shaft are each configured to rotate about an axis of rotation and are spaced a spacing distance from one another. The roller carrier assembly also includes a first grain crushing roller and a second grain crushing roller, where each of the grain crushing rollers includes a plurality of teeth extending from a root a tooth height. The first grain crushing roller is coupled to the first support shaft and the second grain crushing roller is coupled to the second support shaft, and the first grain crushing roller and the second grain crushing roller are intermeshed with one another such that the first grain crushing roller and the second grain crushing roller are maintained at a position spaced apart from one another by an overlap distance less than the tooth height.

In yet another embodiment, a grain crushing apparatus kit includes a mill body having a first sidewall and a second sidewall spaced apart from one another a throat dimension in a first direction. The grain crushing apparatus kit also includes a roller carrier assembly that is selectively extendible from the mill body. The roller carrier assembly includes a first mount plate and a second mount plate spaced apart from another in the first direction, and a first support shaft and a second support shaft positioned transverse to the first mount plate and the second mount plate. The first support shaft and the second support shaft each configured to rotate about an axis of rotation and are spaced a spacing distance from one another. The grain crushing apparatus kit also includes plurality of grain crushing rollers each having a plurality of teeth extending from a root a tooth height. A first grain crushing roller is adapted to be selectively coupled to the first support shaft and a second grain crushing roller is adapted to be selectively coupled to the second support shaft, where the first grain crushing roller and the second grain crushing roller are intermeshed with one another such that the first grain crushing roller and the second grain crushing roller are maintained at a position spaced apart from one another by an overlap distance less than the tooth height. At least two of the grain crushing rollers have outer diameters different from one another such that the overlap distance between the first grain crushing roller and the second grain crushing roller is adjustable.

The preferred embodiment of the continuation in part and the special grain crushing process is comprised of a several specific steps as shown in the description below and the accompanying drawings. It is a method for processing grain comprising: a) STEP 1: growing the grain 31 in the field; b) STEP 2: harvesting or combining 32 the grain; c) STEP 3: shelling 33 the grain (optional); d) STEP 4: cleaning 34 the grain to remove non-organics such as rocks, dirt, excess silage; e) STEP 5: storing 35 which may be short term gathering the grain for processing or long term storage in elevators of grain lots or such; f) STEP 6: special, iterative crushing operation 40 with special crush machine 200 or the like; g) STEP 7: sieve processing 35; h) STEP 8: secondary storing 36 and/or; optional packaging 37 and/or; optional secondary processing 39 (steam, liquid, heat, cold, vacuum or the like) wherein the method provides a tightly controlled size of the crushed grain and protects the germ pouch/clump of cells of the grain from cutting and rupturing. One notes that the newly invented special grain crushing process may be accomplished at low volumes by very simple means and in high volume production by more complex and controlled systems.

OBJECTS, BENEFITS AND ADVANTAGES

There are several objects, benefits and advantages of the special grain crushing process. An object of the present disclosure is to crush grains into pre-determined sizes without rupturing of cutting the germ pouch. It is believed the berm pouch is resilient in nature. Therefore, if cutting and slicing or complete mashing (which all three are present in the mill process) may be avoided, the germ pouch may be preserved and extended shelf life of the crushed grain may be substantially extended. As far as known, there are currently no known grain processes that are effective at providing the objects of this invention.

Succinctly the advantages of the continuation in part processes may be summarized as:

1. Protects the germ pouch/clump of cells
2. Eliminates grain waste
3. Reduces energy cost
4. Reduces production cost
5. Eliminates natural nutrient loss
6. Maintains natural nutritional value of the grain
7. Has greater particle size uniformity
8. Reduces the crushed grain fines or dust
9. Can process a wider variety of grains with the use of one machine
10. Reduces manure toxins
11. Reduces time from birth to market time for animals raised The Features and Benefits are:

| Feature | Benefit |
|---|---|
| Uses 100% of all feed or grain | Decreases the amount of grain needed to put animal on market.<br>Can have animal at market weight in a shorter period of time<br>Reduces time from birth to market |
| Does not rupture germ pouch | Able to preserve all nutritional value of grain by selectively breaking the germ pouch/clump or cells and not staring the decay process<br>The end product is as good as the feed crushed (organic)<br>Maintains natural nutritional value of the grain |
| No rancidity | Amount of toxins will be less<br>Less manure produced by animals reducing the newer toxins |
| Choice of micron sized based on needs | Apparatus setting and number of iterations can be custom built to suit the feeding needs of the user |
| Can produce a wider variety of grains with the use of one machine | Machine can be custom-built to crush a variety of grains<br>Can crush many different grains and sizes by changing apparatus rollers |
| Reduces energy and production costs | Reduces energy costs by crushing more grain and a faster amount of time<br>Reduces production cost by the animal being able to use/absorb all of the grain |

Finally, other advantages and additional features of the present special grain crushing process will be more apparent from the accompanying drawings and from the full description of the device. For one skilled in the art of heated mat devices for vehicles, it is readily understood that the features shown in the examples with this product are readily adapted to other types of heated mat systems and devices.

DESCRIPTION OF THE DRAWINGS—FIGURES

The accompanying drawings, which are incorporated in and constitute a part of this specification, illustrate an embodiment of the special grain crushing process that is preferred. The drawings together with the summary description given above and a detailed description given below serve to explain the principles of the special grain crushing process. It is understood, however, that the Special grain crushing process is not limited to only the precise arrangements and instrumentalities shown.

FIGS. 17 A through 17 F are sketches of the general special grain crushing process as iterations for sizing the grain crushed pieces and clumps of grain.

Figure 14:
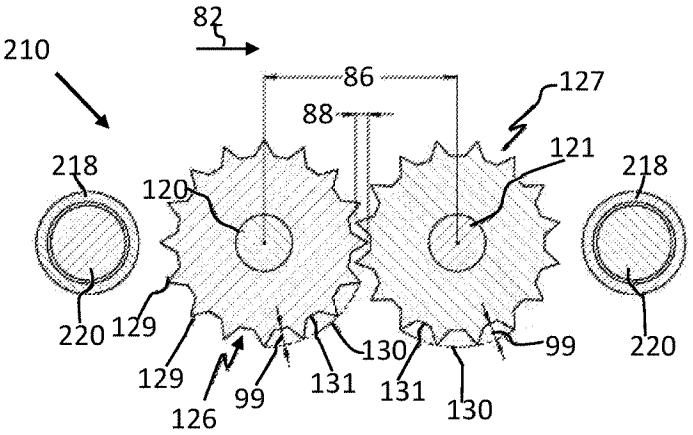
FIG. 14 is a front sectional view of a roller carrier assembly for a grain crushing apparatus according to one or more embodiments of the present disclosure.
Figure 13:
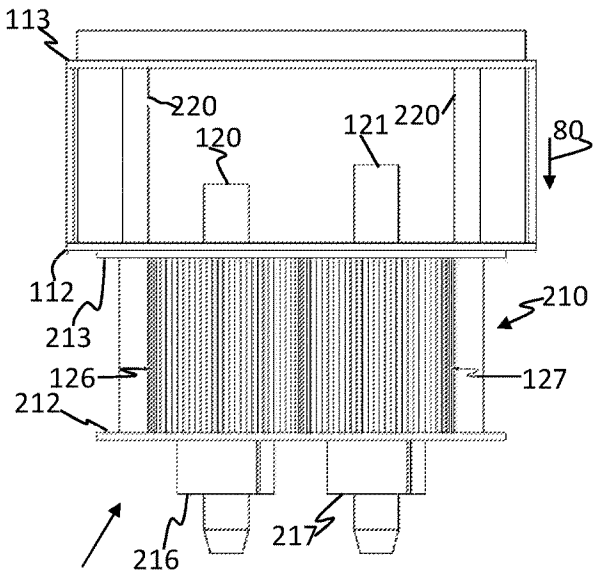
FIG. 13 is a top view of a grain crushing apparatus including a roller carrier assembly positioned in a deployed position according to one or more embodiments of the present disclosure.
Figure 18A:
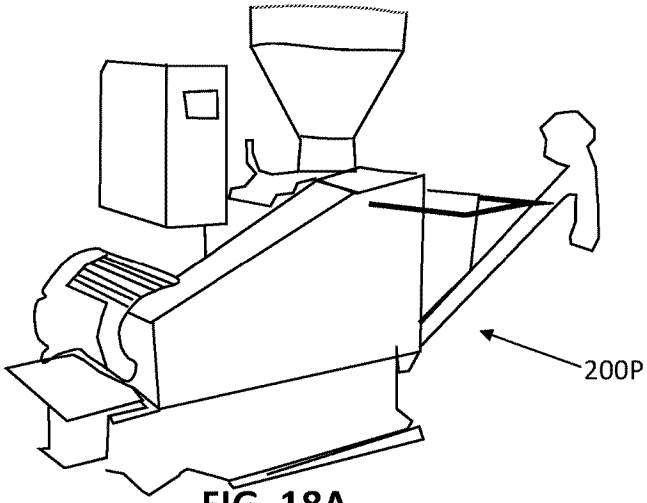
Figure 18B:
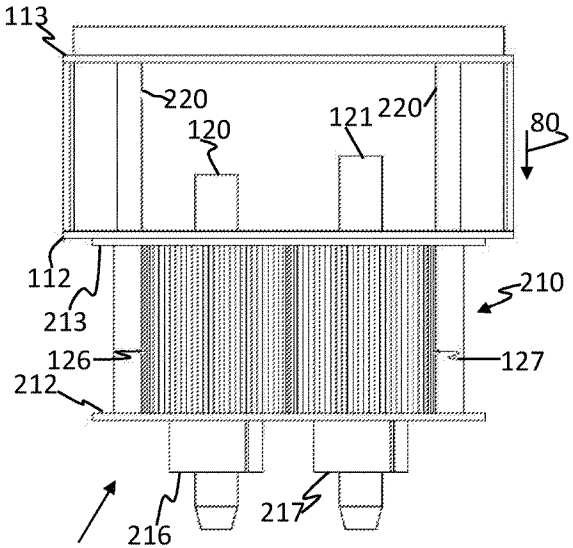
Figure 18C:
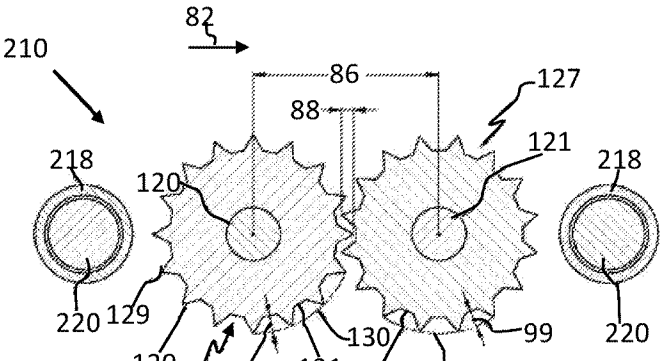

FIG. 18A and FIGS. 18B and 18C which are repeated FIGS. 13 and 14 are sketches of example equipment for performing the special grain crushing process from several views.

Figures 19, 19A, 19B, 19C, 19D, 19E:
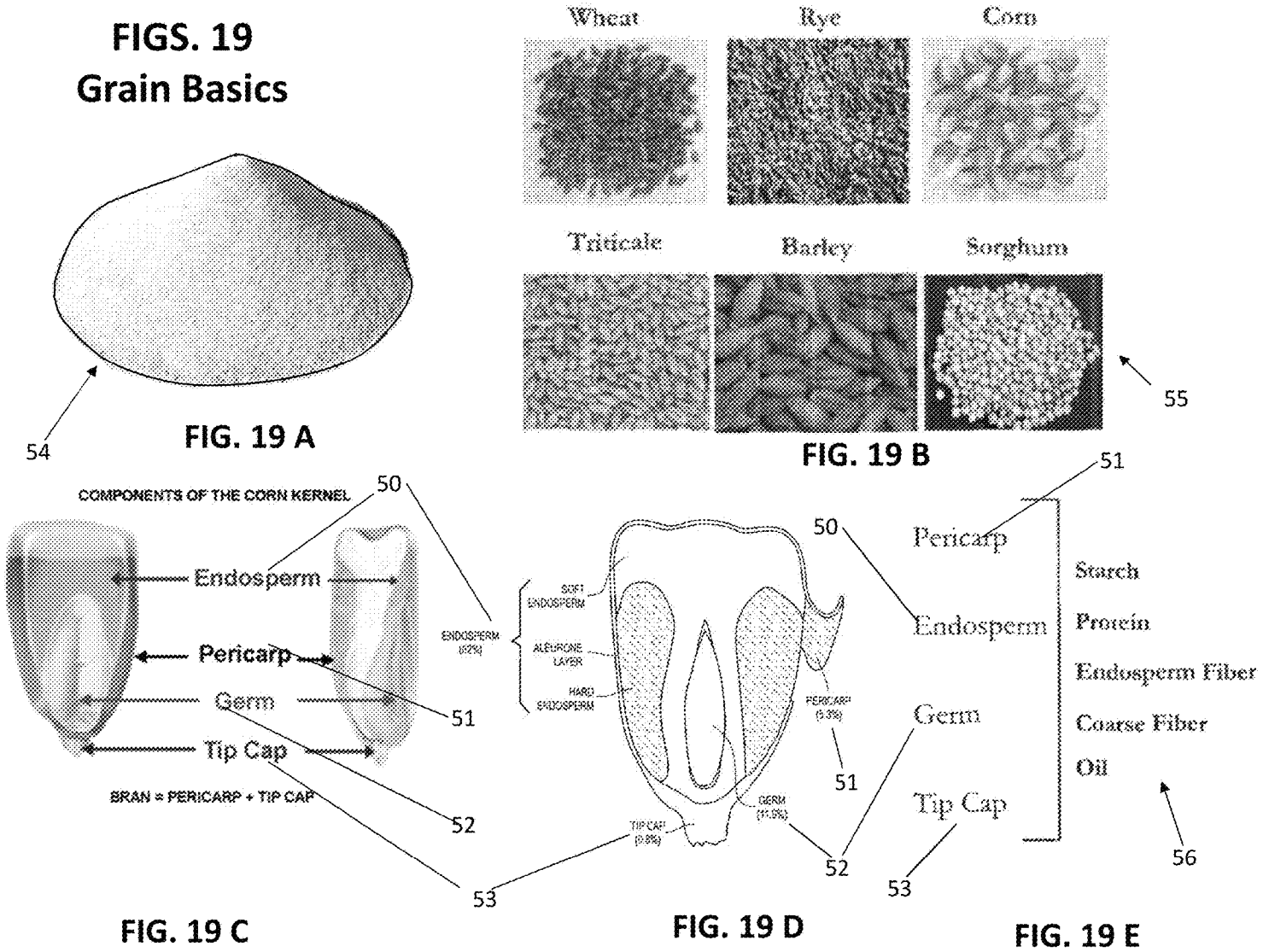

FIGS. 19 A through 19 E are sketches of a grain basics and features shown for typical grain parts.

Figures 20, 20A, 20B, 20C, 20D:
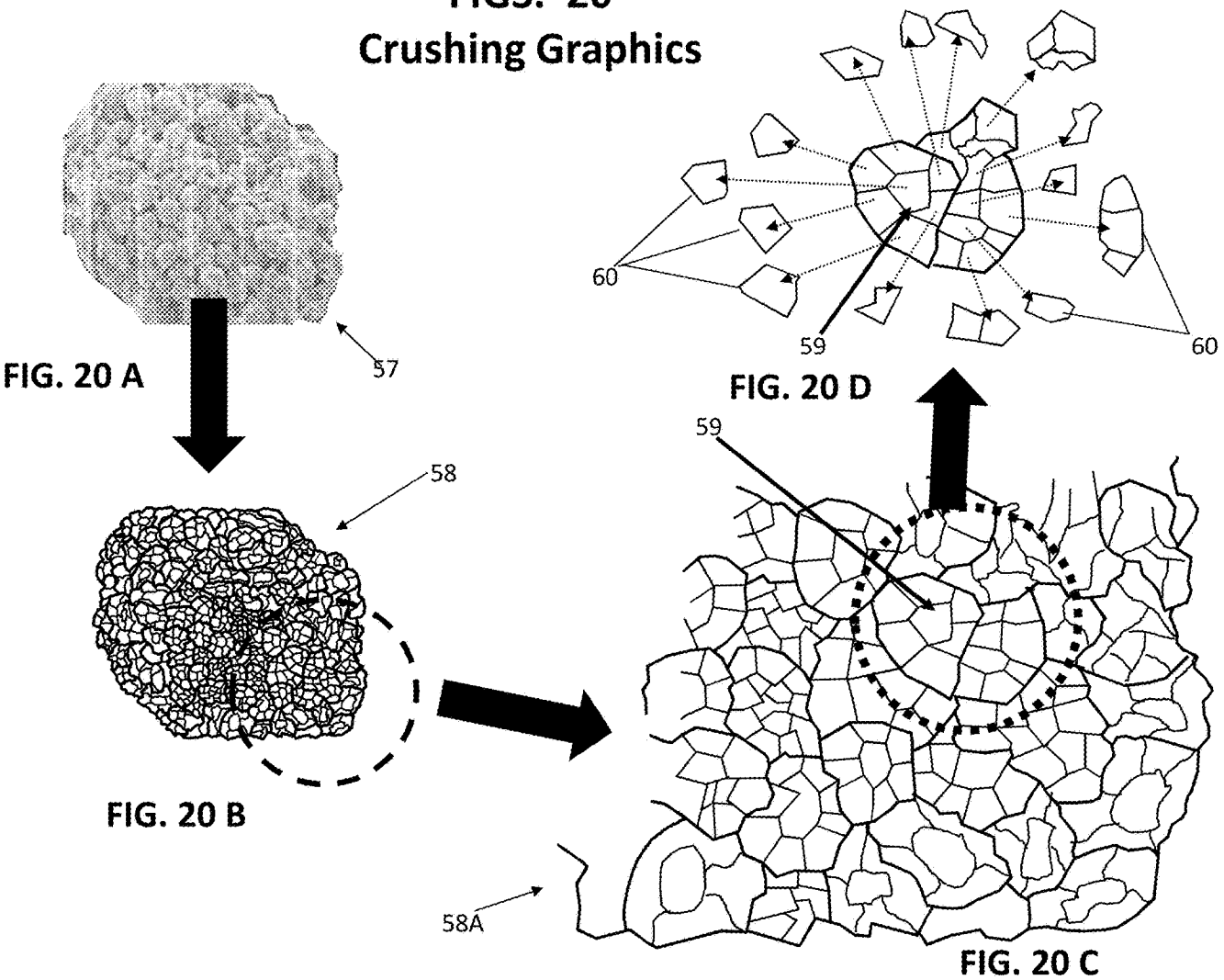

FIGS. 20 A through 20 D are sketches of a typical kernel of grain (corn) showing the way the parts (clumps and florets) and pieces divide and split during a special grain crushing process.

Figures 21, 21C:
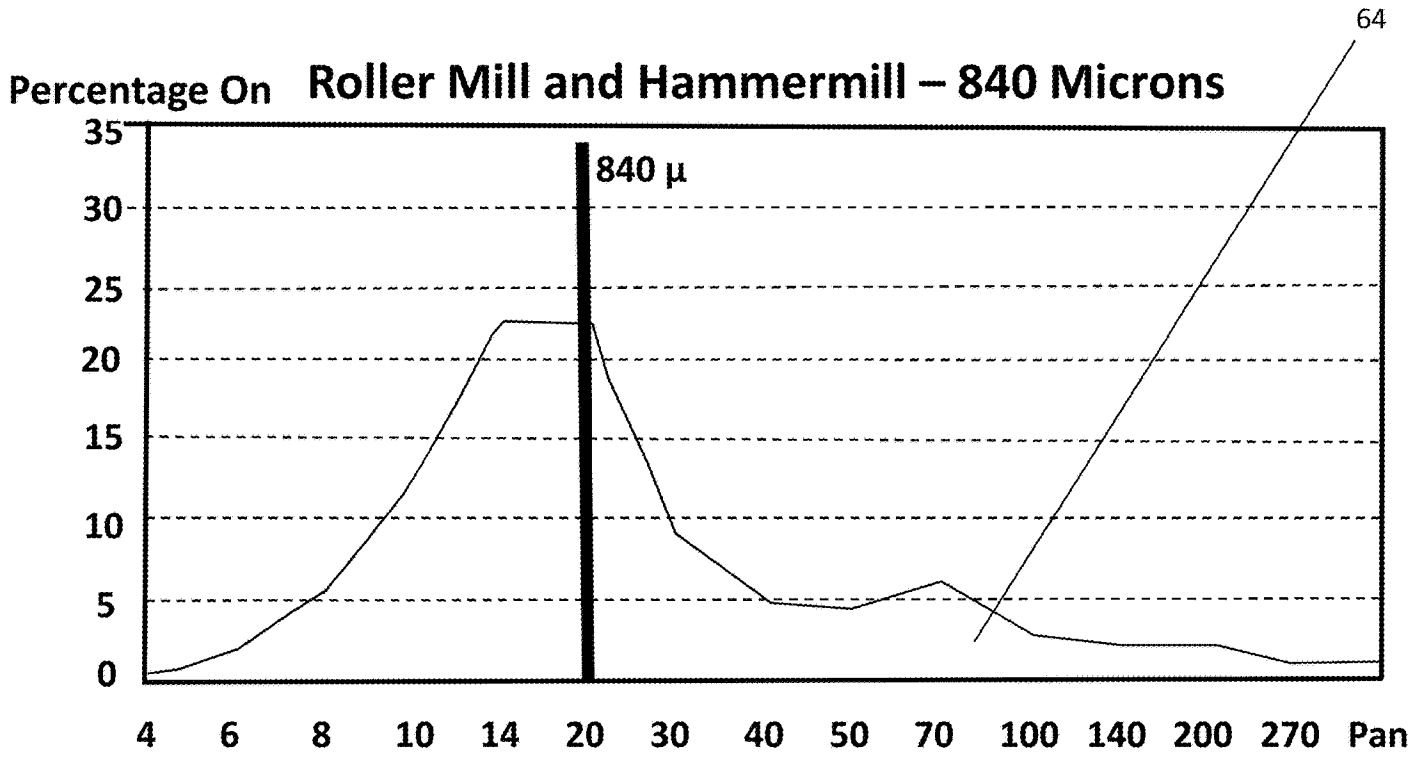
Figure 21D:
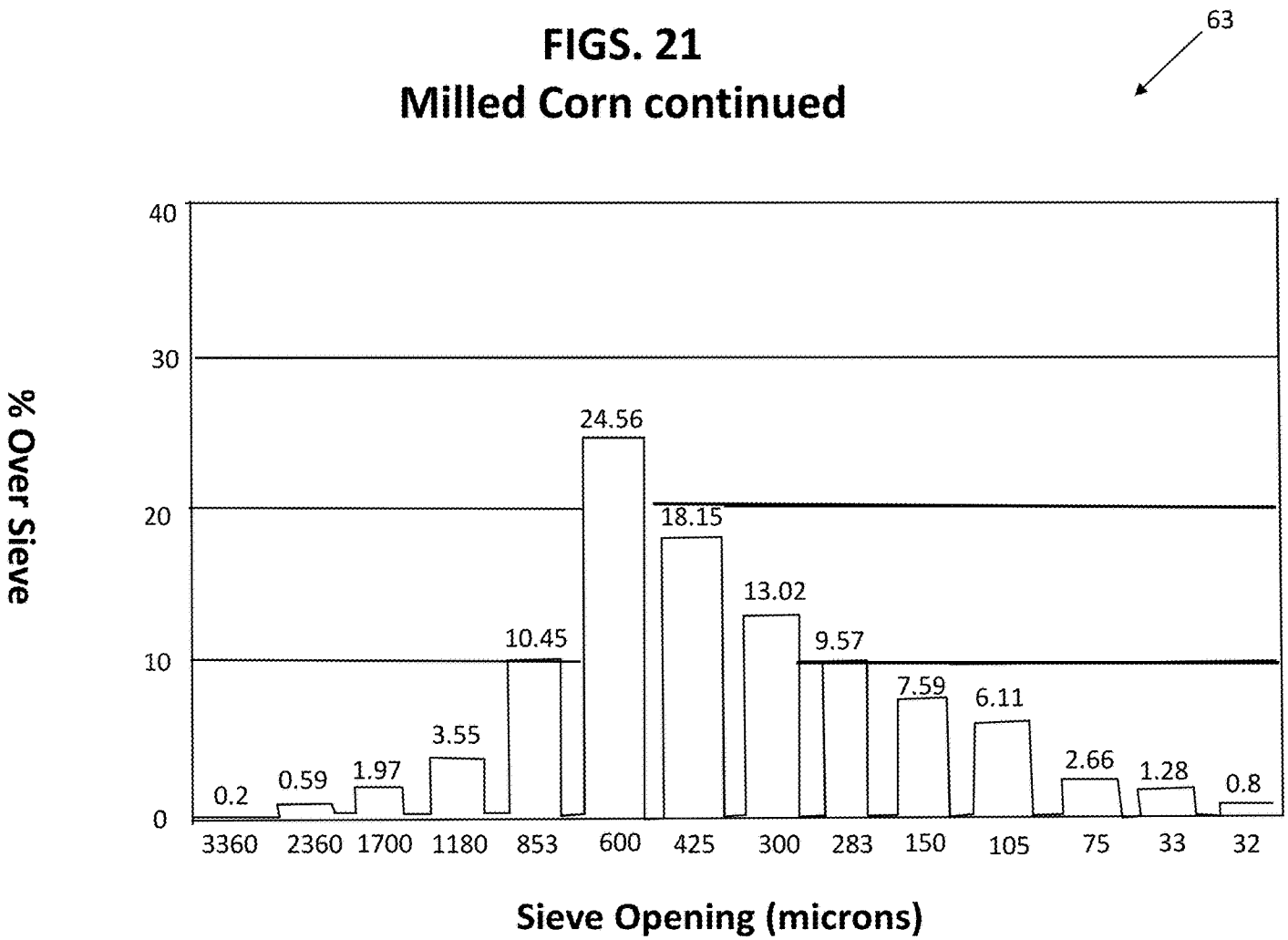

FIGS. 21 A through 21 D are graphs and tables for milling corn and demonstrating how milled corn divides.

FIGS. 22 A and B are tables for crushed corn using the special grain crushing process.

FIGS. 23 A through D are other tables with more crushed corn results using the special grain crushing process.

FIGS. 24 A through D are other tables with crushed wheat results using the special grain crushing process.

FIGS. 25 A and B are tables with crushed corn and wheat results using the special grain crushing process.

FIGS. 26 A and B are Confirmation Tables of analysis of tight and controlled crush process completed by the Universities.

FIGS. 27 A through 12 27 F are graphs of the results for various crushing (left) and typical milling (right side) with the tight crush results over-laid to easily compare the results of the crush versus milling processes.

DESCRIPTION OF THE DRAWINGS—REFERENCE NUMERALS

The following list refers to the drawings:

TABLE B

Reference numbers

Figure 6:
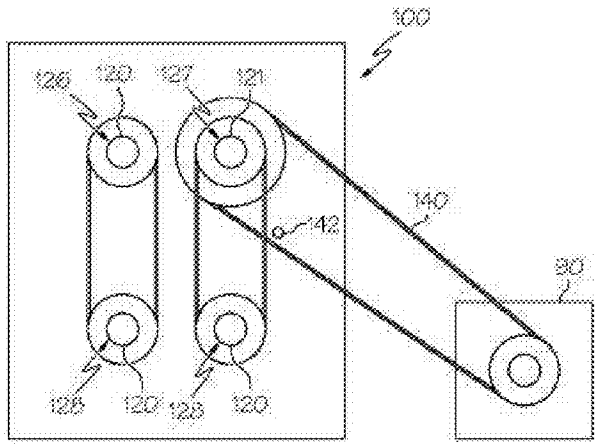
FIG. 6 is a side view of a grain crushing apparatus according to one or more embodiments of the present disclosure.

| Ref # | Description |
|---|---|
| 30 | the special grain crushing process 30 a/k/a micro crushing, [and incremental] |
| 31 | grain 31 in the field |
| 32 | harvest 32 or combine the grain |
| 33 | shell 33 the grain (optional) |
| 34 | clean grain 34 to remove non-organics such as rocks, dirt, excess silage |
| 35 | storage 35 - short or long term |
| 36 | sieve process 36 |
| 37 | secondary storage 37 |
| 38 | packaging 38 |
| 39 | secondary processing 39 (steam, liquid, heat, cold, vacuum or the like) |
| 40 | crush operation 40 with special crush machine or the like |
| 41 | iterations 41 of the crushing [incremental] |
| 42 | serial crush 42 through one machine A |
| 43 | multiple crush [incremental] 43 through more than one machine A |
| 44 | multiple crush 44 through various spacing 45 - here A and B |
| 44A | multiple crush 44A through various spacing 45 - here A, B and C |
| 44B | multiple crush 44B through various spacing 45 - here A, C and B\D |
| 45 | crush spacing 45 typical of grain crushing apparatus 200 or equal |
| 45L | crush spacing A (45L) - largest - coarse |
| 45M | crush spacing B (45M) - medium - medium coarse |
| 45S | crush spacing C (45S)- small - medium fine |
| 45F | crush spacing D (45F) - finest - fine |
| 50 | endosperm |
| 51 | pericarp 51 |
| 52 | germ/germ sack/pouch/clump of cells 52 |
| 53 | tip cap 53 |
| 54 | pile of crushed grain 54 |
| 55 | typical grains 55 - preprocess |
| 56 | nutrients 56 from kernel |
| 57 | typical kernel 57 enlarged photo |
| 58 | sketch 58 of enlarged kernel |
| 58A | enlarged sketch 58A of enlarged kernel |
| 59 | enlarged section of kernel 59 as small clump or floret |
| 60 | multi-sized pieces 60 of the clump after crushing |
| 61 | sieve values 61 shown as micron sizes for reference in Tables 7-10 |
| 62 | weights 62 in grams of corn kernel of specific sieve or micron sized particles |
| 63 | bar graph 63 of sample corn kernel weights of table 62 in FIG. 6 B |
| 64 | another example 64 (not 6 B) of line graph of sample corn kernel weights |
| 70 | table of analysis 70 of various sized crushed corn |
| 71 | another table 71 of analysis of more various sized crushed corn |

TABLE B-continued

Reference numbers

| Ref # | Description |
|---|---|
| 72 | Table of analysis of various sized crushed wheat |
| 73 | comparison table 73 of analysis of crushed corn and wheat |
| 74 | table of analysis 74 of tight and controlled crush process and resultant grouping for large animals such as horses and cows |
| 74A | tight and controlled crush process and resultant grouping 74A for large animals such as horses and cows interposed over typical milled corn of a normally distributed particle size from very coarse to inedible dust |
| 75 | table of analysis 75 of tight and controlled crush process and resultant grouping for medium large animals such as hogs |
| 75A | tight and controlled crush process and resultant grouping 75A for large animals such as hogs interposed over typical milled corn of a normally distributed particle size from very coarse to inedible dust |
| 76 | table of analysis 76 of tight and controlled crush process and resultant grouping for animals such as poultry |
| 76A | tight and controlled crush process and resultant grouping 76A for large animals such as poultry interposed over typical milled corn of a normally distributed particle size from very coarse to inedible dust |
| 77 | confirmation table 77 of analysis of tight and controlled crush process and resultant grouping for several animals completed by Purdue University and measured by University of Missouri of the results of the various sized openings 45 used in the grain crushing apparatus 200 and micro crushing process 30 |
| 80 | first directional spacing 80 |
| 82 | second direction 82 |
| 84 | throat dimension 84 of the grain crushing apparatus |
| 86 | support shaft 120, 121 spacing distance 86 |
| 88 | spacing distance 88 (i.e., the distance between the respective axis of rotation 122) that provides clearance between teeth 129 |
| 90 | driving mechanism 90 |
| 99 | tooth height 99 |
| 100 | grain crushing apparatus 100 |
| 102 | mill body 102 |
| 112 | first sidewall 112 |
| 113 | second sidewall 113 |
| 114 | first cavity 114 |
| 115 | second cavity 115 |
| 116 | first datum face 116 |
| 117 | second datum face 117 |
| 120 | first support shaft 120 |
| 120a | alternative first support shaft 120a |
| 121 | second support shaft 121 |
| 121a | alternative second support shaft 121a |
| 122 | axis of rotation 122 |
| 123 | bore diameters 123 |
| 124 | locator block 124 |
| 125 | flange 125 |
| 126 | first grain crushing roller 126 |
| 126a | alternative first grain crushing roller 126a |
| 127 | second grain crushing roller 127 |
| 127a | alternative second grain crushing roller 127a |
| 128 | finishing rollers 128 |
| 129 | teeth 129 |
| 130 | outer diameters 130 |
| 131 | root diameters 131 |
| 140 | flexible drive member 140, for example, a belt or a chain |
| 142 | tensioning mechanism 142, |
| 150 | bearings 150 |
| 152 | surface plates 152 |
| 154 | clamp 154 |
| 156 | drive sprocket 156 |
| 200 | grain crushing apparatus 200 |
| 200P | grain crushing apparatus prototype 200P |
| 210 | roller carrier assembly 210 |

TABLE B-continued

Reference numbers

| Ref # | Description |
|---|---|
| 212 | first mount plate 212 |
| 213 | second mount plate 213 |
| 214 | clearance opening 214 |
| 215 | bearing elements 215 |
| 216 | first clamp shaft 216 |
| 217 | second clamp shaft 217 |
| 218 | alignment opening 218 |
| 220 | mounting shaft 220 |
| 222 | lateral locking elements 222 |

DETAILED DESCRIPTION OF PREFERRED EMBODIMENT

Embodiments of the previously disclosed invention are directed to grain crushing apparatuses for processing grain from whole kernels into smaller particulates, including processing whole grains into meal or flour. The grain crushing apparatuses include a mill body having a first sidewall and a second sidewall spaced apart from one another in a first direction, a first support shaft and a second support shaft positioned transverse to the first sidewall and the second sidewall. The first support shaft and the second support shaft are each configured to rotate about an axis of rotation and are rigidly spaced a spacing distance apart from one another. The grain crushing apparatus also includes a first grain crushing roller and a second grain crushing roller, each including a plurality of teeth extending from a root a tooth height, where the respective grain crushing rollers are coupled to the support shafts such that the first and second grain crushing rollers are intermeshed with one another and are maintained at a position spaced apart from one another by an overlap distance less than the tooth height. The grain crushing rollers counter rotate relative to one another such that grain introduced between the sidewalls proximate to the grain crushing rollers is ingested by the grain crushing rollers and crushed by the interaction between the intermeshed teeth of the grain crushing rollers. Control of the overlap distance between the adjacent grain crushing rollers allows for the consistency of the crushed grain particles to be controlled.

The present continuation in part processes is a special grain crushing process using the original disclosed apparatus. The present continuation in part is generally directed to agriculture-related processes, and, more particularly, to grain processing using the previously disclosed apparatus in U.S. patent application Ser. No. 13/558,938.

Newly taught here is a special grain crushing process. Taught here are the ways of addressing and processing grains such that they are crushed with a controlled process such that the germ bags or pouches/clump of cells are not disturbed or cut and such that the resultant product is secured so that decay and rancidity does not happen. Hence the shelf life of the crushed grain is significantly increased. The special grain crushing process is a controlled Micro-size Crushing of the grain. This is a method that will process grain effectively and efficiently. Particle size can be controlled to meet needs of customers to do a specific job. By controlling the micron size all good value in feed will be used in the digestion process. There will be little or no waste of food, better feed conversions, less toxins emitted from wastes and more profit for feed lot operations. The special grain crushing process is able to produce whole grain flours;

there will be no reason to take out the germ (wheat) which will eliminate rancidity problems. There will be no loss of bran. This wheat (flour) is considered to be the "Staff of Life" having better nutrients and allowing people to get back to eating more healthy foods. This flour can also be stored for extended periods of time.

The advantages and benefits for the newly taught grain crushing process were shown above and incorporated here. The preferred embodiment of the special grain crushing process is a method for processing grain comprising: a) STEP 1: growing the grain 31 in the field; b) STEP 2: harvesting or combining 32 the grain; c) STEP 3: shelling 33 the grain (optional); d) STEP 4: cleaning 34 the grain to remove non-organics such as rocks, dirt, excess silage; e) STEP 5: storing 35 which may be short term gathering the grain for processing or long term storage in elevators of grain lots or such; f) STEP 6: special, iterative crushing operation 40 with special crush machine 200 or the like; g) STEP 7: sieve processing 35; h) STEP 8: secondary storing 36 and/or; optional packaging 37 and/or; optional secondary processing 39 (steam, liquid, heat, cold, vacuum or the like) wherein the method provides a tightly controlled size of the crushed grain and protects the germ pouch/clump of cells of the grain from cutting and rupturing.

There is shown in FIGS. 1-15 are a complete description of the incremental grain crushing apparatus. Also, shown in FIGS. 16 through 27 are a complete description and operative steps for the continuation in part of a special grain crushing process. In the drawings and illustrations, one notes well that the FIGS. 1-27 demonstrate the general steps and use of this apparatus and process. The various example uses and results are in the operation and use section, below.

The accompanying drawings, which are incorporated in and constitute a part of this specification, illustrate an embodiment of the special grain crushing process that is preferred. The drawings together with the summary description given above and a detailed description given below serve to explain the principles of the special grain crushing process. It is understood, however, that the special grain crushing process is not limited to only the precise arrangements and instrumentalities shown. Other examples of grain crushing processes and uses are still understood by one skilled in the art of grain crushing, milling and post-harvest preparation methods and equipment devices to be within the scope and spirit shown here.

Figure 1:
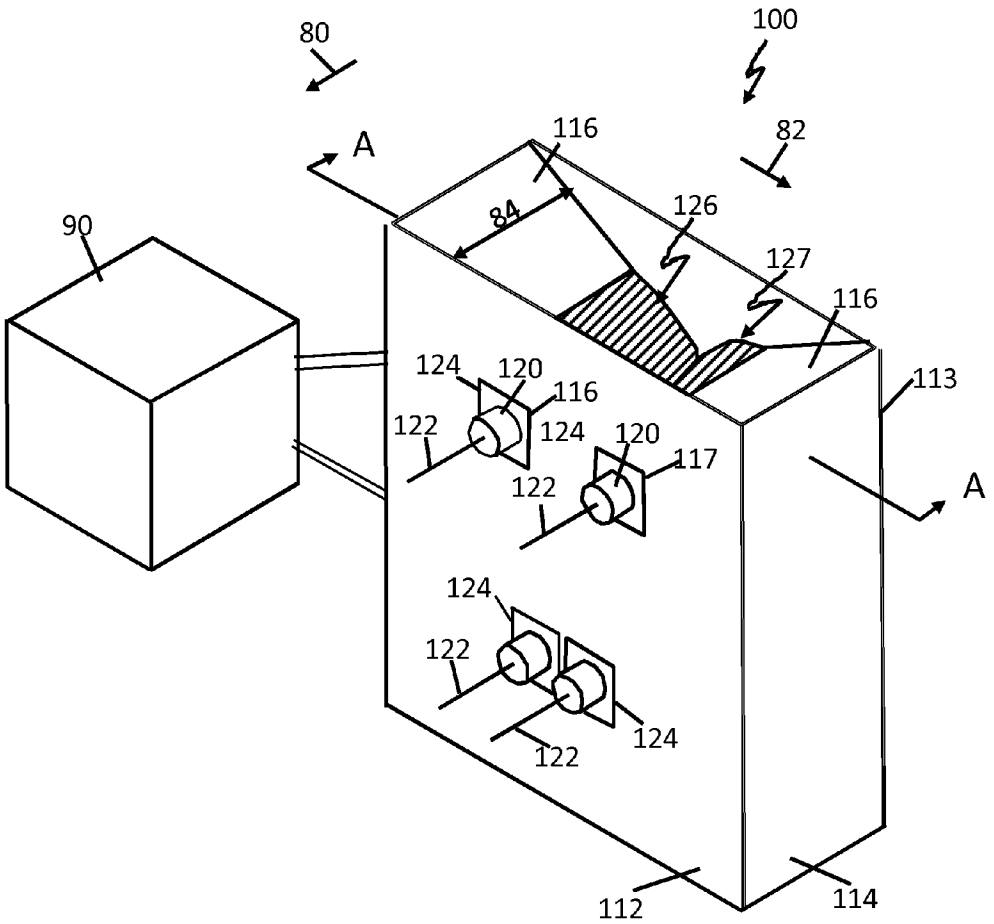
FIG. 1 is a side perspective view of a grain crushing apparatus including locator blocks according to one or more embodiments of the present disclosure.

One embodiment of a grain crushing apparatus 100 is depicted in FIG. 1. The grain crushing apparatus 100 includes mill body 102 having a first sidewall 112 and a second sidewall 113 that are spaced apart from one another in a first direction 80. The spacing between the first sidewall 112 and the second sidewall 113 define a throat dimension 84 of the grain crushing apparatus 100. The mill body 102 also includes end walls 106 positioned proximate to the ends of the first and second sidewalls 112, 113. The grain crushing apparatus 100 also includes at least a first support shaft 120 and a second support shaft 121 that are positioned transverse to the first and second sidewalls 112, 113 and extend through the first and second sidewalls 112, 113. Each of the first and second support shafts 120, 121 have an axis of rotation 122 around which the first or second support shaft 120, 121 rotates. The first support shaft 120 and the second support shaft 121 are spaced apart from one another a spacing distance 86 in the second direction 82 that is normal to the first direction 80. In the embodiment depicted in FIG. 1, the axes of rotation 122 of the first and second support shafts 120, 121 are generally perpendicular to the first and second sidewalls 112, 113 of the grain crushing apparatus 100.

The grain crushing apparatus 100 also includes a first grain crushing roller 126 coupled to the first support shaft 120 and a second grain crushing roller 127 coupled to the second support shaft 121. Each of the first and second grain crushing rollers 126, 127 are installed into the grain crushing apparatus 100 such that the grain crushing rollers 126, 127 are positioned proximate to an opening 104 defined by the first and second sidewalls 112, 113 having the throat dimension 84. In the embodiment depicted in FIGS. 1 and 2, the grain crushing apparatus 100 includes a plurality of locator blocks 124 that are selectively coupled to the first and second sidewalls 112, 113 of the grain crushing apparatus 100. The first sidewall 112 of the grain crushing apparatus 100 includes a first cavity 114 and the second sidewall 113 includes a second cavity 115 positioned opposite the first cavity 114 into which the locator blocks 124 are positioned. Each of the first and second cavities 114, 115 include a respective first and second datum face 116, 117.

Figure 2:
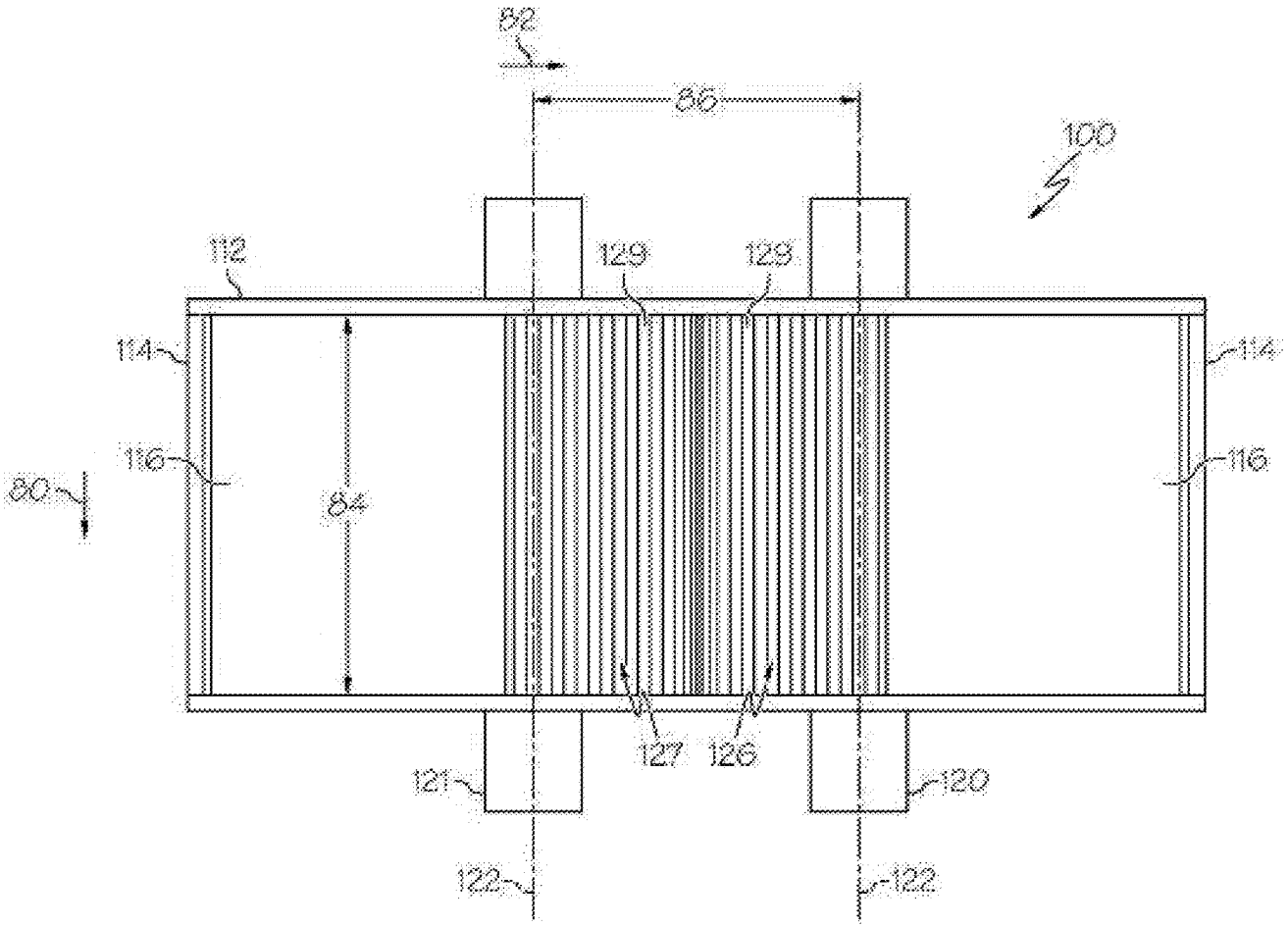
FIG. 2 is a top view of a grain crushing apparatus including locator blocks according to one or more embodiments of the present disclosure.

Referring now to FIG. 2, a top view of the grain crushing apparatus 100 is depicted. Grain kernels, including, but not limited to, wheat, corn, rice, barley, and oats, that are introduced to the grain crushing apparatus 100 are directed towards the first and second grain crushing rollers 126, 127 by the guide plates 108. As the grain crushing rollers 126 rotate towards one another, the individual teeth 129 on the grain crushing rollers 126 intermesh with one another and draw the grain kernels through the grain crushing apparatus 100. As the individual teeth 129 on adjacent first and second grain crushing rollers 126, 127 approach the minimum distance between one another, the spacing between teeth 129 on adjacent first and second grain crushing rollers 126, 127 crush the grain into particles. The size of the particle produced by the first and second grain crushing rollers 126, 127 is determined by the spacing between the axis of rotation 122 of the first and second grain crushing rollers 126, 127.

Figure 4:
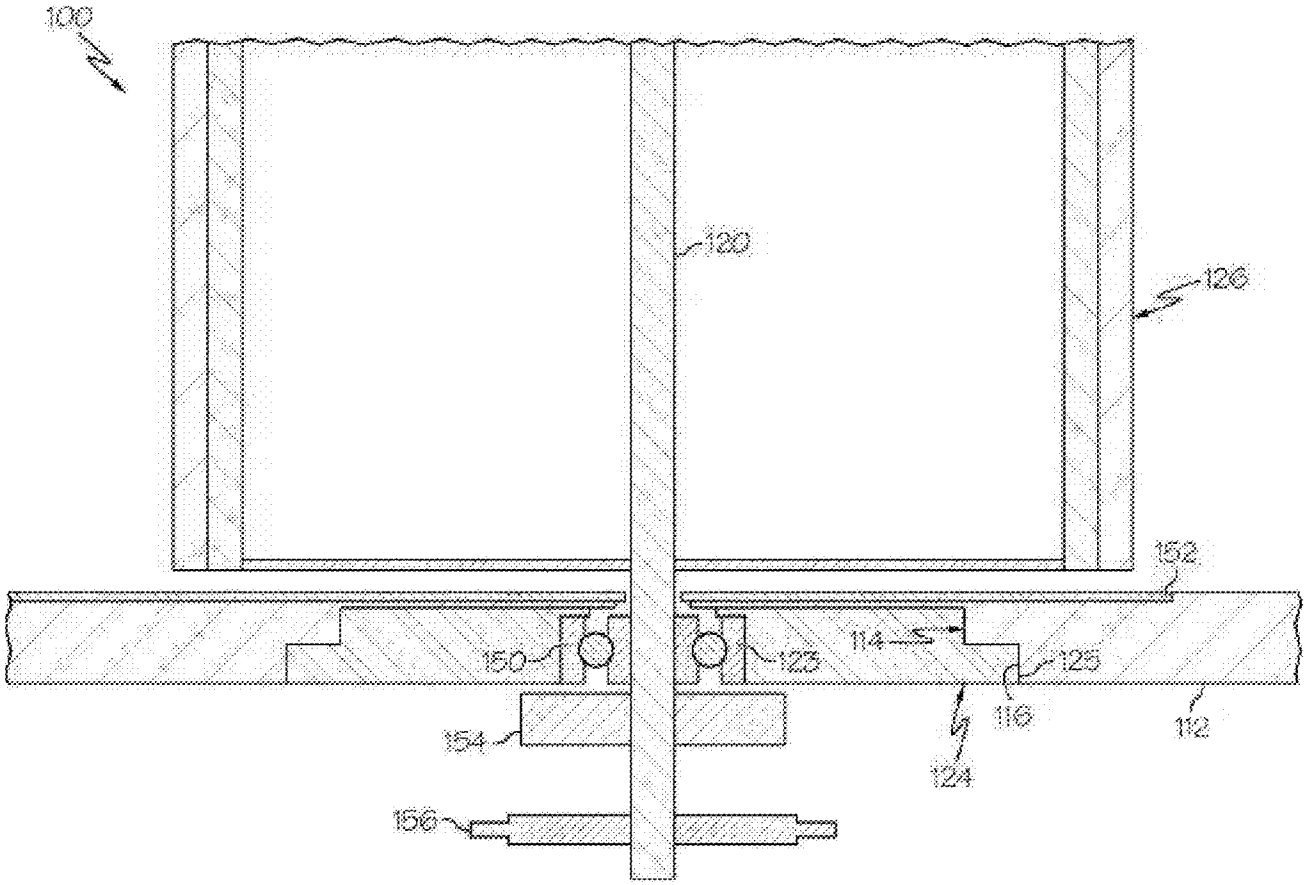
FIG. 4 is a sectional top view of a grain crushing apparatus according to one or more embodiments of the present disclosure depicted along line B-B of FIG. 6.

Referring now to FIG. 4, a generic version of the interface between the locator block 124 and one of the sidewalls 112 is depicted. The locator blocks 124 each include bore diameters 123. When the grain crushing rollers 126, 127 are installed into the grain crushing apparatus 100, the support shafts 120 pass through the bore diameters 123 of the locator blocks 124. The locator blocks 124 control the location and the spacing of the first and second support shafts 120, 121 and therefore, the control the spacing between the grain crushing rollers 126 themselves. The locator blocks 124 rigidly position the support shafts 120, and therefore the grain crushing rollers 126, such that the position of adjacent grain crushing rollers 126 is maintained throughout a grain processing operation. In some embodiments, the position of the locator blocks 124 within the first and second cavities 114, 115 are controlled by contacting the respective datum faces 116, 117 of the first and second cavities 114, 115, The locator blocks 124 depicted in FIG. 4 are removable and replaceable, such that a locator block 124 having a different location of the bore diameter 123 relative to the respective datum face 116, 117 can be exchanged into the first and second cavities 114, 115 of the first and second sidewall 112, 113, respectively. By exchanging locators block 124 having different relative positioning of the bore diameters 123, the spacing distance 86 between the grain crushing rollers 126 can be adjusted to meet the requirements of a particular grain processing operation, while otherwise maintaining the rigidity of the positioning of the grain crushing rollers 126.

Still referring to FIG. 4, the grain crushing apparatus 100 includes the sidewall 112 and the roller 126 coupled to a support shaft 120 having an axis of rotation 122 generally perpendicular to the sidewall 112. While specific mention is made herein to a single sidewall 112, support shaft 120, cavity 114, locator block 124, and datum face 117, it should be understood that grain crushing apparatuses 100 according to the present disclosure may include a plurality of such items arrange proximate to each of the grain crushing rollers 126, 127. The locator block 124 is placed within a cavity 114 in the first sidewall 112. A bore diameter 123 passes through the locator block 124. A bearing, for example a roller 126 element bearing, is inserted into the bore diameter 123. The support shaft 120, onto which the roller 126 is coupled, is inserted through the inner race of the bearing. Thus, relative positioning of the bore diameter 123 along the locator block 124 determines the position of the roller 126 along the second direction 82 in the grain crushing apparatus 100. A clamp 154 is coupled to the support shaft 120 outside of the first sidewall 112 of the grain crushing apparatus 100, which limits axial motion of the support shaft 120, and therefore the roller 126 in the direction of the axis of rotation 122. A drive sprocket 156 is coupled to the support shaft 120. The drive sprocket 156 for the driven roller 126 is coupled to a driving mechanism 90 through the drive belt or chain, as will be discussed below.

As depicted in FIG. 4, the locator blocks 124 include a flange 125 that mates with the corresponding cavity 114 in the sidewall 112. The locator block 124 and the corresponding cavity 114 in the sidewall 112 may include features that allow the locator block 124 to be installed in only one position and one orientation relative to the sidewalls 112. Such features, such as the flange 125, that control the position and orientation of the locator block 124 within the cavity 114 of the sidewall 112, prevent a user from assembling the grain crushing apparatus 100 incorrectly. These features also allow a user to easily and reliably interchange locator blocks 124 having bore diameters 123 located at different positions. Other "lock-and-key" features that ensure proper assembly of the locator blocks 124 along the sidewalls 112 of the grain crushing apparatus 100 are contemplated.

By supplying locator blocks 124 having bore diameters 123 that are positioned to provide variation in the spacing, a grain crushing apparatus 100 can be configured to grind grain to a variety of final particle size. The locator blocks 124 allow for adjustability, while maintaining rigidity in the spacing between the first and second grain crushing rollers 126, 127 as depicted in FIG. 2. Thus, a set of locator blocks 124 may be supplied with a grain crushing apparatus 100 as a kit, such that an end user can assemble the grain crushing apparatus 100 such that the first and second grain crushing rollers 126, 127 are positioned relative to one another with the appropriate spacing to deliver the required final particle size of the grain.

Surface plates 152 are coupled to the sidewalls 112 of the grain crushing apparatus 100 and positioned adjacent to the grain crushing roller 126. The surface plates 152 prevent direct contact between the grain crushing rollers 126 and either of the locator blocks 124 or the sidewalls 112 of the grain crushing apparatus 100. The shear plate may be made of a material that has a low sliding coefficient of friction with steel, for example bearing bronze.

Various seals (not shown in FIG. 4) may be located adjacent to the locator blocks 124 and the support shafts 120. The seals prevent grain from being force away from the working surfaces of the grain crushing rollers 126 and from being introduced to the bearings 150. The seals may also prevent lubricants or other external debris from being introduced to the internal components of the grain crushing apparatus 100, which may contaminate the grain processed through the grain crushing apparatus 100.

Figure 3:
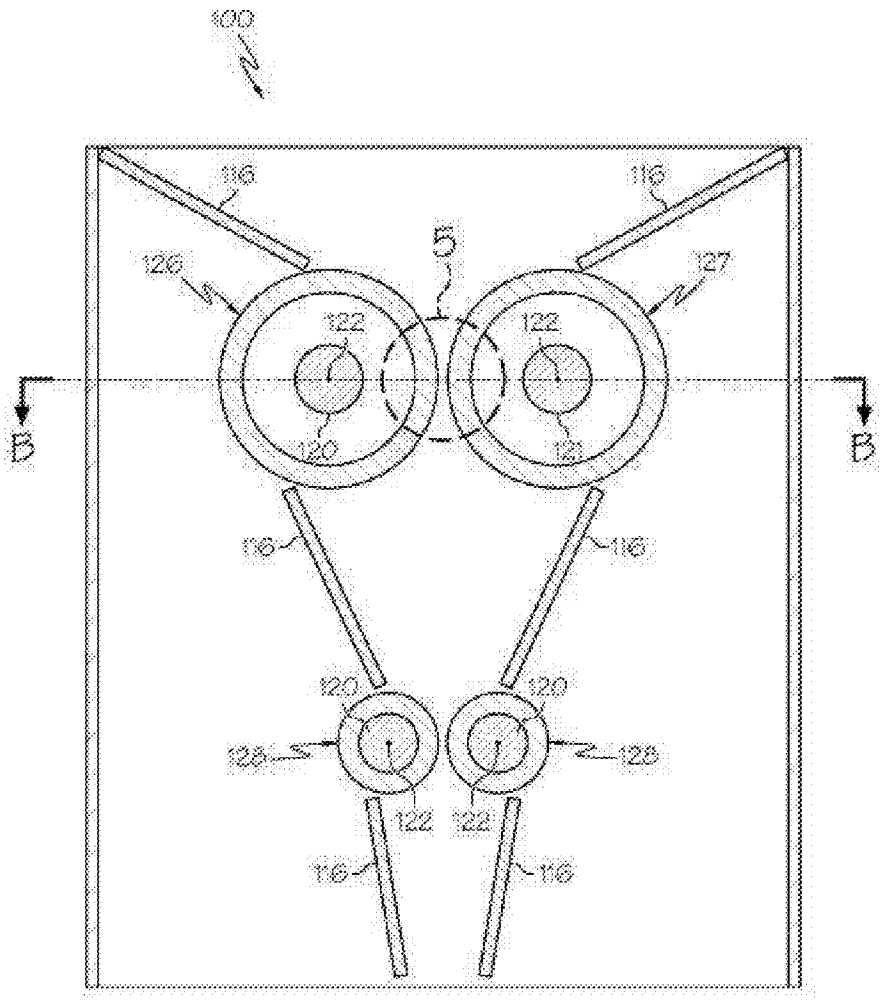
FIG. 3 is a sectional side view of a grain crushing apparatus according to one or more embodiments of the present disclosure depicted along line A-A of FIG. 1.
Figure 5:
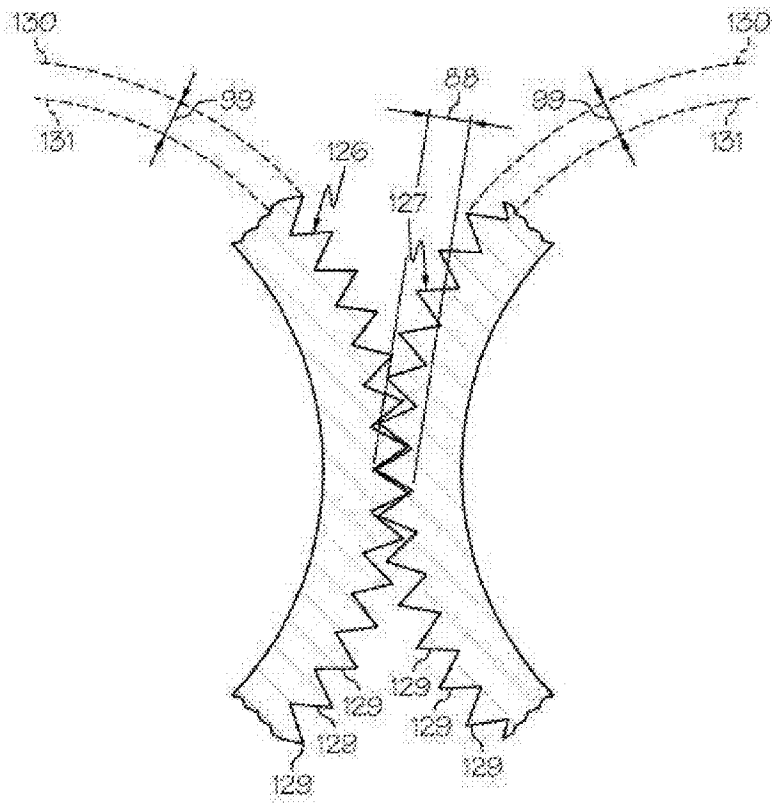
FIG. 5 is a detail view of the grain crushing apparatus of a grain crushing apparatus according to one or more embodiments of the present disclosure depicted in FIG. 2.
Figure 9:
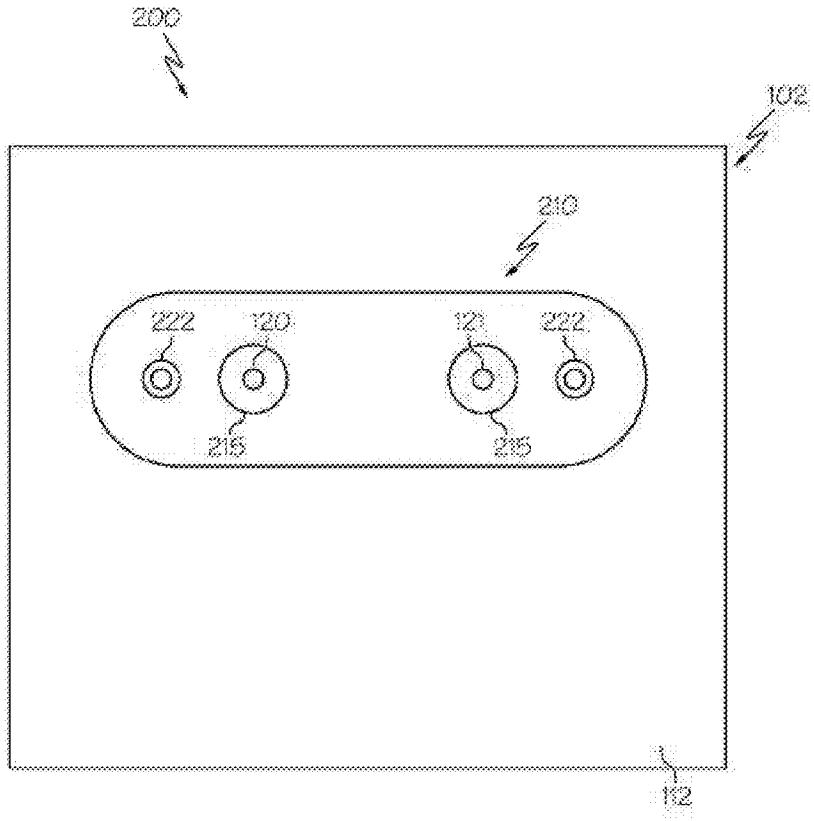
FIG. 9 is a front view of a grain crushing apparatus including a roller carrier assembly according to one or more embodiments of the present disclosure.

The components of an embodiment of the grain crushing apparatus 100 are further depicted in FIG. 3, which is shown in greater detail in FIG. 5. A set of first and second grain crushing rollers 126, 127 are positioned spaced relative to one another such that the axes of rotation 122 of the first and second support shafts 120, 121, and therefore the first and second grain crushing rollers 126, 127, is generally perpendicular to the first and second sidewalls 112, 113. Referring to FIG. 5, the teeth 129 of the first and second grain crushing rollers 126, 127 project away from a root diameter 131 of the first and second grain crushing rollers 126, 127, towards an outer diameter 130. The first and second grain crushing rollers 126, 127 may be manufactured using a variety of techniques including, but not limited to, broaching, bobbing, and/or electric discharge machining. The distance between the outer diameter 130 of the teeth 129 and the root diameter 131 of the first and second grain crushing rollers 126, 127 is defined as the tooth height 99. The grain crushing rollers 126 are positioned such that the teeth 129 of the corresponding first and second grain crushing rollers 126, 127 intermesh with one another. The first and second grain crushing rollers 126, 127 are spaced apart from one another a spacing distance 86 (i.e., the distance between the respective axis of rotation 122) that provides clearance between teeth 129 of the adjacent first and second grain crushing rollers 126, 127. The distance between the teeth 129 is controlled such that a minimum spacing is maintained between the teeth 129. The teeth 129 of the first and second grain crushing rollers 126, 127 are maintained at a position spaced apart from one another an overlap distance 88 (i.e., the distance between nearest teeth 129 of adjacent grain crushing rollers 126, 127) that is less than the tooth height 99. Therefore, the outer diameter 130 of the first and second grain crushing rollers 126, 127 intersect one another, while the root diameters 131 of the first and second grain crushing rollers 126, 127 do not intersect one another.

The teeth 129 (or lobes) of the first and second grain crushing rollers 126, 127 may take a variety of shapes, including having straight cut teeth 129 (i.e., a spur gear), having a triangular cross-sectional shape, or having helical shaped lobes. The first and second grain crushing rollers 126, 127 may be installed into the space between the sidewalls 112 of the grain crushing apparatus 100 such that the teeth 129 of the rolls at least partially intermesh with one another. The first and second grain crushing rollers 126, 127 may be spaced apart from one another such that there is not complete engagement of the intermeshed teeth 129 of adjacent first and second grain crushing rollers 126, 127, such that is some clearance between the outer diameter 130 of one of the first and second grain crushing rollers 126, 127 and the root diameter 131 of the opposite of the first and second grain crushing rollers 126, 127. This clearance distance may be set by the combination of the root diameter 131 and outer diameter 130 of each of the first and second grain crushing rollers 126, 127 and the distance between the support shafts 120, 121 (i.e., the spacing distance 86) about which the first and second grain crushing rollers 126, 127 are adapted to rotate.

Referring again to FIG. 3, in some embodiments of the grain crushing apparatus 100, a set of finishing rollers 128 may be positioned generally perpendicular to the sidewalls 112 at a location below the first and second grain crushing rollers 126, 127. Similar to the first and second grain crushing rollers 126, 127, the finishing rollers 128 are positioned on support shafts 120, 121. These support shafts 120, 121 upon which the finishing rollers 128 are positioned by the locator blocks 124. Thus, similar to the first and second grain crushing rollers 126, 127 discussed hereinabove, spacing between the finishing rollers 128 is controlled by the features of the locator blocks 124 and the location of the locator blocks 124 along the first and second sidewalls 112, 113 of the grain crushing apparatus 100.

The finishing rollers 128 may include a variety of surfaces finishes around the circumference of the finishing rollers 128 that act with the grain processed through the first and second grain crushing rollers 126, 127 to modify the appearance of the grain. In one embodiment, the finishing rollers 128 include a knurled surface around the circumference. Adjacent finishing rollers 128 having a knurled surface are separated from one another a fixed distance such that the finishing rollers 128 do not contact one another. Grain processed through the first and second grain crushing rollers 126, 127 is introduced to the finishing rollers 128, which apply force to the grain to separate components of the grain that have previously been crushed by passing through the first and second grain crushing rollers 126, 127. The finishing rollers 128 may improve the appearance of the grain by replicating flour or meal produced by other processing techniques. Providing a grain with acceptable appearance may be important to satisfy purchasers of the processed grain.

The grain crushing apparatus 100 also includes guide plates 108 that are inserted into the sidewalls 112. The guide plates 108 direct grain towards the first and second grain crushing rollers 126, 127 or the finishing rollers 128 for processing. The guide plates 108 may assist with collection of grain that has been processed through the first and second grain crushing rollers 126, 127 and finishing rollers 128 by limiting the area in which the grain may be ejected from the first and second grain crushing rollers 126, 127 and the finishing rollers 128. This may improve handling of the processed grain through the grain crushing apparatus 100 and increase cleanliness of operation by reducing the amount of grain that is diverted away from the desired processing path through the grain crushing apparatus 100.

The grain crushing apparatus 100 depicted in FIG. 6 includes a driving mechanism 90 coupled to at least one of the support shafts 120 to which one of the first or second grain crushing roller 126, 127 is coupled. The driving mechanism 90 is coupled to the support shaft 120 through a flexible drive member, for example, a belt 140 or a chain. As the teeth 129 of adjacent first and second grain crushing rollers 126, 127 mesh with one another, only one of a set of adjacent first and second grain crushing rollers 126, 127 needs to be coupled to the driving mechanism 90. As depicted, the second grain crushing roller 127 that is coupled to the driving mechanism 90 applies a force to the first grain crushing roller 126, which is not coupled to the driving mechanism 90 through the interaction between the intermeshed teeth 129 of the first and second grain crushing rollers 126, 127. As the second grain crushing roller 127 rotates, the teeth 129 of the second grain crushing roller 127 contact the teeth 129 of the first grain crushing roller 126, causing the first grain crushing roller 126 to rotate. The first and second grain crushing rollers 126, 127 may rotate at a speed that corresponds to the ratio of teeth 129 on the first and second grain crushing rollers 126, 127.

The grain crushing apparatus 100 may include a tensioning mechanism 142, for example an idler gear or pulley, whose position is adjusted to provide the desired tension on the belt 140. As depicted in FIG. 6, the finishing rollers 128 are coupled to the first and second grain crushing rollers 126, 127, such that the driving mechanism 90, directly or indirectly, applies torque to all of the support shafts 120, 121 about which the first and second grain crushing rollers 126, 127 and/or the finishing rollers 128 rotate. The feed rate at which the first and second grain crushing rollers 126, 127 ingest grain is determined by the diameter of the first and second grain crushing rollers 126, 127 and the speed at which the first and second grain crushing rollers 126, 127 rotate. Similarly, the feed rate of the finishing rollers 128 is determined by the diameter of the finishing rollers 128 and the speed at which the finishing rollers 128 rotate. The nominal feed rates of the first and second grain crushing rollers 126, 127 and the finishing rollers 128 may be set such that the nominal feed rate of the finishing rollers 128 exceeds the nominal feed rate of the first and second grain crushing rollers 126, 127, such that a significant volume of grain does not build up inside the grain crushing apparatus 100 between the first and second grain crushing rollers 126, 127 and the finishing rollers 128.

Figure 7:
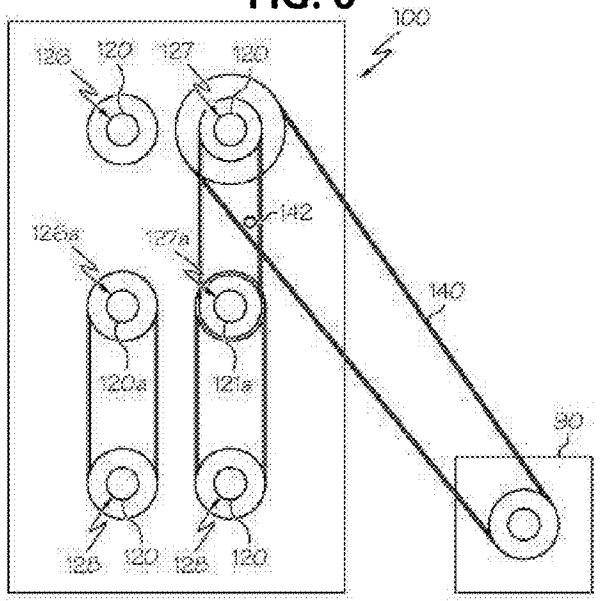
FIG. 7 is a side view of a grain crushing apparatus according to one or more embodiments of the present disclosure.

Without being bound by theory, processing grain into smaller particle sizes (i.e., small average micron) requires more power as the size of the particles decrease. More work is required to be input to the grain crushing apparatus 100 to crush the grain into smaller particles. To process the grain to smaller particle sizes, a more powerful driving mechanism 90 may be employed that is capable of applying greater torque to the first and second grain crushing rollers 126, 127. Alternatively, or in addition, a second set of first and second grain crushing rollers 126*a*, 127*a* may be installed into the grain crushing apparatus 100, as depicted in FIG. 7. The use of a second set of grain crushing rollers 127 in combination with the grain crushing rollers 126*a*, 126*b* may decrease the total power required to be input to the grain crushing apparatus 100 in order to process the grain to the desired final particle size. Similar to the discussion hereinabove with regard to FIG. 6, the feed rates of the grain crushing apparatus 100 components may be set such that the finishing rollers 128 have a nominal feed rate greater than the second set of first and second grain crushing rollers 126*a*, 127*a*, which themselves nominal feed rate greater than the first set of grain crushing rollers 126, 127.

Figure 8:
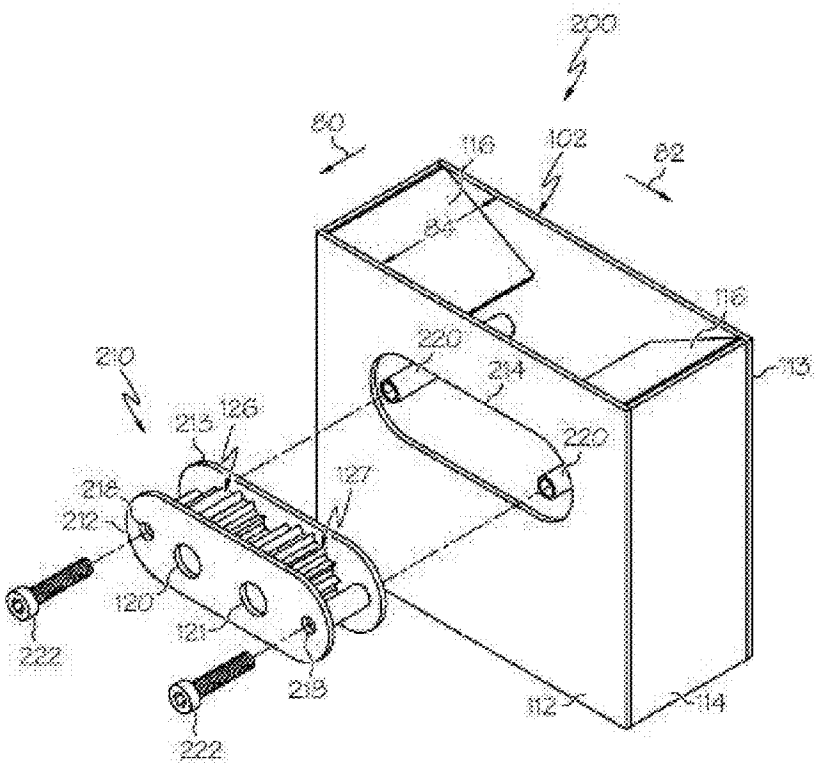
FIG. 8 is an exploded side perspective view of a grain crushing apparatus including a roller carrier assembly according to one or more embodiments of the present disclosure.

Another embodiment of the grain crushing apparatus 200 is depicted in FIGS. 8-15. Referring now to FIG. 8, in this embodiment, the grain crushing apparatus 200 includes mill body 102 having a first sidewall 112 and a second sidewall 113 that are spaced apart from one another in a first direction 80. The spacing between the first sidewall 112 and the second sidewall 113 define a throat dimension 84 of the grain crushing apparatus 100. The mill body 102 also includes endwalls 106 positioned proximate to the ends of the first and second sidewalls 112, 113. The grain crushing apparatus 100 also includes a roller carrier assembly 210 that is selective extendible from the first sidewall 112 and/or the second sidewall 113 in the first direction 80.

Figure 10:
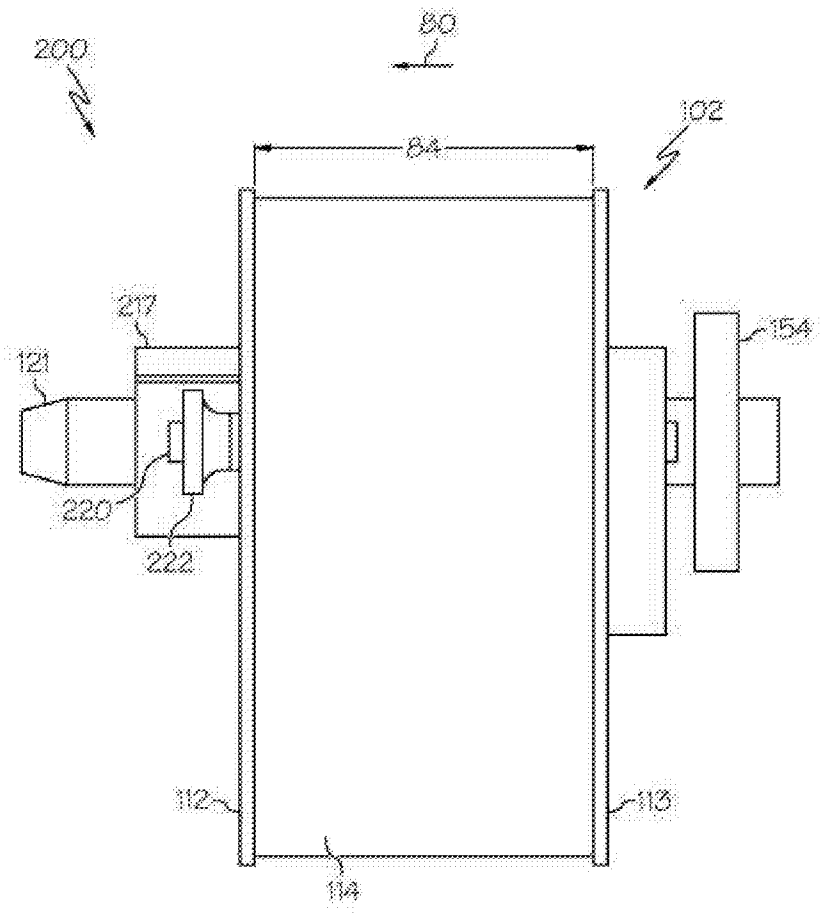
FIG. 10 is side view of a grain crushing apparatus including a roller carrier assembly according to one or more embodiments of the present disclosure.
Figure 12:
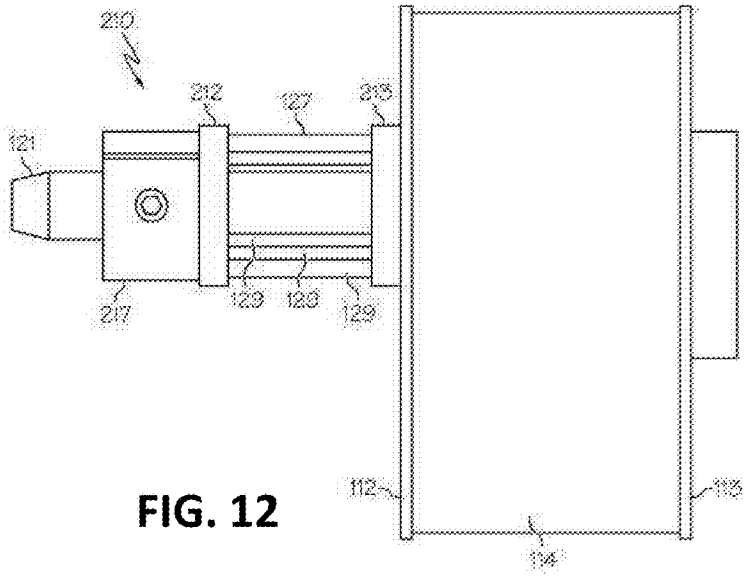
FIG. 12 is a side view of a grain crushing apparatus including a roller carrier assembly positioned in a deployed position according to one or more embodiments of the present disclosure.
Figure 11:
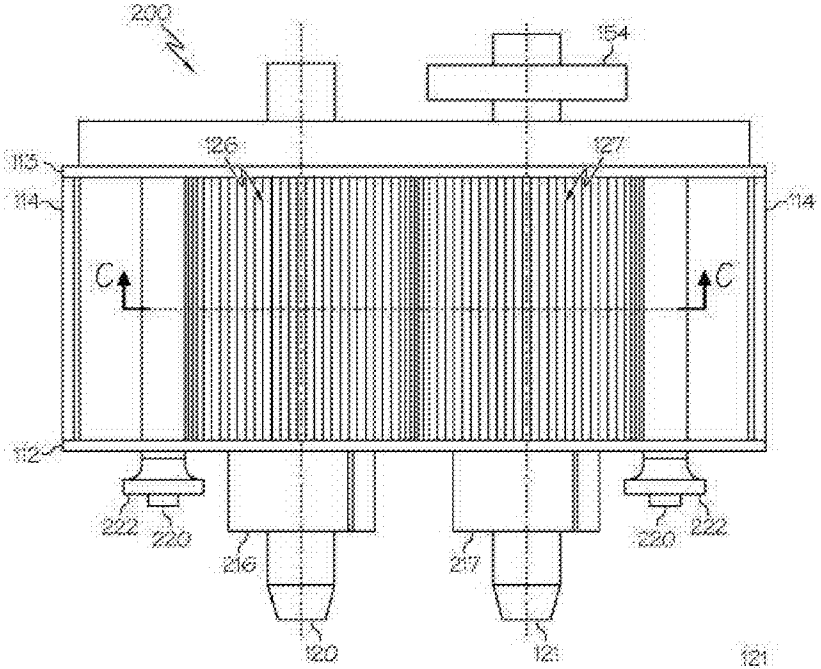
FIG. 11 is a top view of a grain crushing apparatus including a roller carrier assembly according to one or more embodiments of the present disclosure.

In the depicted embodiment, the roller carrier assembly 210 is selectively extendible from the first and second sidewalls 112, 113 of the mill body 102 of the grain crushing apparatus 200. In the embodiment depicted in FIG. 8, the first and second sidewalls 112, 113 each include a clearance opening 214 into which the roller carrier assembly 210 is positioned. The roller carrier assembly 210 may be flush-mounted with the clearance opening 214, such that there is a minimal gap between the first and second mount plates 212, 213 and the first and second sidewalls 112, 113 themselves. The mill body 102 may also include at least one laterally mounting shaft 220 that extends in the first direction 80. The roller carrier assembly 210 includes at least one alignment opening 218 that extends in the first direction 80. The alignment openings 218 of the roller carrier assembly 210 are positioned around the lateral mounting shafts 220. The alignment openings 218 allow the roller carrier assembly 210 to be positioned between a collapsed position (as depicted in FIGS. 10 and 11, and a deployed position, as depicted in FIGS. 12 and 13. For clarity, further detail of the roller carrier assembly 210 will be described in regard to FIGS. 12 and 13 below.

Similar to the embodiment described hereinabove in regard to FIGS. 1-7, the grain crushing apparatus 200 depicted in FIGS. 8-15 includes a drive mechanism rotationally coupled to one of the first support shaft 120 or the second support shaft 121. In the embodiment depicted in FIGS. 10 and 11, a drive sprocket 156 is coupled to one of the first or second support shafts 120, 121. The drive sprocket 156 is coupled to a driving mechanism 90 through the drive belt or chain. The driving mechanism 90 directly controls rotation of the first or second support shaft 120, 121 to which the drive sprocket 156 is coupled, while rotation of the opposite of the first or second support shaft 120, 121 is controlled by the intermeshing of the first and second grain crushing rollers 126, 127, as described hereinabove in regard to FIGS. 1-7.

Referring to FIGS. 10 and 11, the grain crushing apparatus 200 includes a lateral locking mechanism 222 that selectively couples the roller carrier assembly 210 to the lateral mounting shafts 220. In the embodiment depicted in FIGS. 10 and 11, the lateral mounting shafts 220 may include threaded portions (not shown) and the lateral locking mechanism 222 may include a threaded nut. To couple the roller carrier assembly 210 to the lateral mounting shafts 220, and therefore the first and second sidewalls 112, 113 of the mill body 102, the lateral locking mechanism 222 may be tightened against the roller carrier assembly 210 as to tighten against the threaded portion of the lateral mounting shafts 220. To selectively decouple the roller carrier assembly 210 from the mill body 102, the lateral locking mechanisms 222 may be unthreaded from the lateral mounting shafts 220.

With the lateral locking mechanisms 222 disengaged from the lateral mounting shafts 220, the roller carrier assembly 210 may be repositioned from the collapsed position (as depicted in FIGS. 10 and 11) to the deployed position (as depicted in FIGS. 12 and 13). Referring now to FIGS. 12 and 13, the roller carrier assembly 210 includes a first mount plate 212 and a second mount plate 213 that are spaced apart from one another in the first direction 80. The roller carrier assembly 210 also includes a first support shaft 120 and a second support shaft 121 that are positioned transverse to the first and second sidewalls 112, 113 and the first and second mount plate 212, 213 and extend through the first and second sidewalls 112, 113 and the first and second mount plates 212, 213. Each of the first and second support shafts 120, 121 (with the spacing distance 86) have an axis of rotation 122 around which the first or second support shaft 120, 121 rotates. The first and second mount plate 212, 213 include bearing elements 215 that contact the first or second support shaft 120, 121 and maintain the position of the first and second support shafts 120, 121 relative to the first and second mount plates 212, 213. The first support shaft 120 and the second support shaft 121 are spaced apart from one another a spacing distance 88 in the second direction 82 normal to the first direction 80. In the embodiment depicted in FIGS. 8-15, the axes of rotation 122 of the first and second support shafts 120, 121 are generally perpendicular to the first and second sidewalls 112, 113 of the mill body 102 and the first and second mount plates 212, 213 of the roller carrier assembly 210. The roller carrier assembly 210 further includes a first grain crushing roller 126 coupled to the first support shaft 120 and a second grain crushing roller 127 coupled to the second support shaft 121.

The first support shaft 120 is secured to the first and second mount plates 212, 213 of the roller carrier assembly 210 with a first shaft clamp 216. Similarly, the second support shaft 121 is secured to the first and second mount plates 212, 213 with a second shaft clamp 217. The first and second shaft clamps 216, 217 may be selectively removed from the first or second support shaft 120, 121, thereby disengaging the first or second support shaft 120, 121 from the first and second mount plates 212, 213. By disengaging the first or second shaft clamps 216, 217 from the respective first or second support shaft 120, 121, the respective first or second grain crushing roller 126, 127 may be selectively removed from the roller carrier assembly 210. As such, the first and second grain crushing roller 126 may be interchanged with alternative grain crushing rollers 126, 127, including those having different outer diameters 130 and root diameters 131. By varying the clearance distance between the teeth 129 and the root diameters 131, first and second grain crushing rollers 126, 127 may be fitted within the roller carrier assembly 210 to process grain to the desired consistency.

Figure 15:
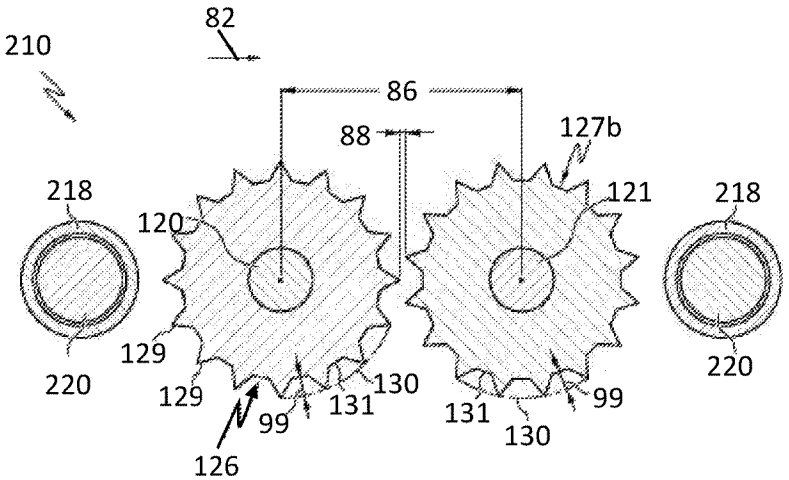
FIG. 15 is a front sectional view of a roller carrier assembly for a grain crushing apparatus according to one or more embodiments of the present disclosure.

Referring now to FIGS. 14 and 15, cross-sectional views of the roller carrier assembly 210 including various sized first and second grain crushing rollers 126, 127 are depicted. Similar to the discussion hereinabove, the first and second grain crushing rollers 126, 127 each teeth 129 that project away from a root diameter 131 towards an outer diameter 130. The distance between the outer diameter 130 of the teeth 129 and the root diameter 131 of the first and second grain crushing rollers 126, 127 is defined as the tooth height 99. The grain crushing rollers 126 are sized and positioned such that the teeth 129 of the corresponding first and second grain crushing rollers 126, 127 intermesh with one another. The first and second grain crushing rollers 126, 127 are spaced apart from one another a spacing distance 88 (i.e., the distance between the respective axis of rotation 122) that provides clearance between teeth 129 of the adjacent first and second grain crushing rollers 126, 127. The relative positioning between the teeth 129 is controlled such that a minimum spacing is maintained between the teeth 129. The first and second grain crushing rollers 126, 127 are maintained at a position spaced apart from one another an overlap distance 88 less than the tooth height 99. The outer diameter 130 of the first and second grain crushing rollers 126, 127 intersect one another, while the root diameters 131 of the first and second grain crushing rollers 126, 127 do not intersect one another.

The first and second grain crushing rollers 126, 127 are installed into the space provided between the first and second mount plates 212, 213 of the roller carrier assembly 210 such that the teeth 129 of the rolls at least partially intermesh with one another. The first and second grain crushing rollers 126, 127 may be spaced apart from one another such that there is not complete engagement of the intermeshed teeth 129 of adjacent first and second grain crushing rollers 126, 127, such that is some clearance between the outer diameter 130 of one of the first and second grain crushing rollers 126, 127 and the root diameter 131 of the opposite of the first and second grain crushing rollers 126, 127. This spacing distance 88 may be set by the combination of the root diameter 131 and outer diameter 130 of each of the first and second grain crushing rollers 126, 127 and the distance between the support shafts 120, 121 about which the first and second grain crushing rollers 126, 127 are adapted to rotate.

In the embodiments depicted in FIGS. 14 and 15, the first and second support shaft 120, 121 are maintained at the same spacing distance 88 relative to one another. To modify the size of particles produced by the grain crushing apparatus 200, spacing between the first and second grain crushing rollers 126, 127 may be modified. To modify spacing between the first and second grain crushing rollers 126, 127, the roller carrier assembly 210 may be disengaged from the first and second sidewalls 112, 113 of the mill body 102 (as shown in FIG. 8) and the alignment openings 218 may be slid over the lateral mounting shafts 220, such that the roller carrier assembly 210 is positioned in the deployed position (as depicted in FIGS. 12 and 13. With the roller carrier assembly 210 positioned in the deployed position, the first and/or second shaft clamps 216, 217 may be removed from the respective first and/or second shaft 120, 121. The first and/or second shaft 120, 121 may be temporarily removed from the roller carrier assembly 210, thereby allowing the first and/or second grain crushing roller 126, 127 to be removed from the roller carrier assembly 210 and a replacement grain crushing roller 126*b*, 127*b* to be fitted in its place. As such, a variety of grain crushing rollers 126, 126*b*, 127, 127*b* having various sized outer diameters 130, root diameters 131, and teeth 129 may be provided such that the grain crushing rollers 126, 127 may be fitted by an end-user of the grain crushing apparatus 200 within the roller carrier assembly 210, as to modify the relative fineness/coarseness of the grain processed by the grain crushing apparatus.

The roller carrier assembly 210 maintains the position of the grain crushing rollers 126, 126*b*, 127, 127*b*, such that the grain crushing rollers 126, 126*b*, 127, 127*b* are at least partially intermeshed with one another, and such that the overlap distance 88 between teeth 129 of adjacent grain crushing rollers (e.g., 126, 127 or 126*b*, 127*b*) is less than the tooth height 99 of any one of the grain crushing rollers 126, 126*b*, 127, 127*b*.

It should now be understood that grain crushing apparatuses according to the present disclosure crush grain between counter-rotating rollers. By rigidly mounting the rollers relative to one another, spacing between adjacent grain crushing rollers can be constrained such that the particulate size of process grain can be precisely controlled. Controlling the particulate size may improve digestion of the grains by humans and/or livestock. Rigid spacing of adjacent grain crushing rollers may be maintained with locator blocks or with a carrier housing, each of which maintain clearance between adjacent grain crushing rollers that is less than the tooth height of any one of the grain crushing rollers.

Figure 16:
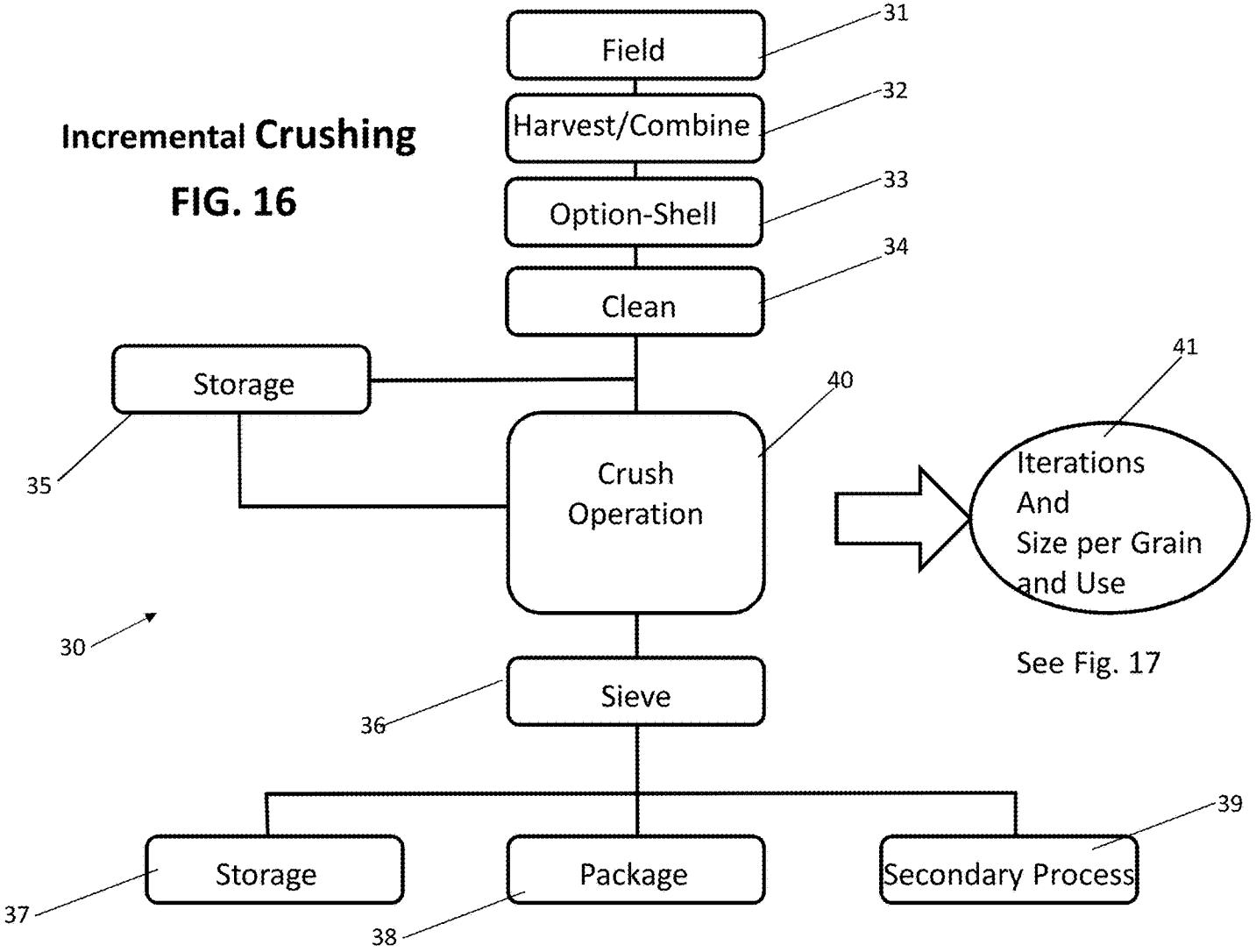
FIG. 16 is a flowchart of the special grain crushing process.

FIG. 16 is a flowchart of the special grain crushing process 30. The special grain crushing process 30 (all steps) is also known as (a/k/a) a micro crushing method of crushing the grain in a fully controlled manner. To better appreciate this, the description herein will describe the grain itself, milling processes and how that impacts the grain, and then the special grain crushing process 30. The full process of grain preparation is shown in FIG. 16. The special grain crushing process 30 diverges from a standard known process of milling to a controlled process of crushing one or more times in a special crushing apparatus 200 or the like. This is described in FIG. 17, below. The main steps of the full special grain crushing process 30 involves growing the grain 31 in the field; then harvesting or combining 32 the grain; then shelling 33 the grain (optional); next one cleans 34 the grain to remove non-organics such as rocks, dirt, excess silage; next there is a storage 35 step which may be short term gathering the grain for processing or long term storage in elevators of grain lots or such; next is the special, iterative crush operation 40 with special crush machine 200 or the like; then a sieve process 35; then secondary storage 36 and/or packaging 37 or an optional secondary processing 39 (steam, liquid, heat, cold, vacuum or the like). One skilled in the art of grain processing appreciates several of these steps such as the plethora of machines and methods to sieve the grain, package, and do secondary operations. Some of these are known in the ethanol processing systems and the DDGS (Dried Distillers Grains with Solubles), a co-product of the

| Step | Description |
|---|---|
| 1 | growing the grain 31 in the field |
| 2 | harvesting or combining 32 the grain |
| 3 | shelling 33 the grain (optional) |
| 4 | cleaning 34 the grain to remove non-organics such as rocks, dirt, excess silage |
| 5 | storing 35 which may be short term gathering the grain for processing or long term storage in elevators of grain lots or such |
| 6 | special, iterative crushing operation 40 with special crush machine 200 or the like |
| 7 | sieve processing 35 |
| 8 | secondary storing 36 and/or |
| 9 | optional packaging 37 and/or |
| 10 | optional secondary processing 39 (steam, liquid, heat, cold, vacuum or the like). |

ethanol production process as a feed in the livestock industry. When ethanol plants make ethanol, they use only starch from corn and grain sorghum. The remaining nutrients—protein, fiber and oil—are the by-products used to create livestock feed called dried distillers grains with solubles. Remarkably, the milling process has not advanced over the ages to protect the grain, especially the germ pouch. The critical and unique step is the special crushing as an iterative process which protects cutting and destroying the continuity of the germ pouch prior to the sieve step.

The steps for the full process 30 are as follows:

FIGS. 17 A through 17 F are sketches of the general special grain crushing process 30 as iterations for sizing the grain crushed pieces and clumps of grain. Shown here is the crush operation 40 with special crush machine 200 or the like. This group of sketches demonstrates the iterations of the crushing 41. For example and not as a limitation, serial crush iterations 42 are shown in FIG. 17 A with the grain processed through one machine with a predetermined spacing A 45L. FIG. 17 B shows a multiple crush 43 through more than one machine A [incremental], each having a predetermined spacing A (coarse) 45L. FIG. 17 C demonstrates another iterative [incremental] process. Here a multiple crush 44 processes the grain through various spacing 45—here A (coarse) 45L and B (medium coarse) 45M. The method first stages the grain through a large opening or spacing and then a medium opening. FIG. 17 D shows a multiple [incremental] crushes 44A through various spacing 45—here A (coarse-large 45L), B (medium coarse—medium spacing 45M) and C (medium fine—small spacing 45S). FIG. 17 E demonstrates one more of the many combinations. Here the multiple crush 44B processes grain through various spacing 45—here A (coarse—large 45L), C (medium fine—small spacing 45S), and D (fine or the finest spacing 45F). One notes in FIG. 17F a table for crush spacing 45 typical of grain crushing apparatus 200 or equal.

It shows the crush spacing A—coarse 45L; crush spacing B—medium coarse 45M; crush spacing C—medium fine 45S; and crush spacing D—fine 45F.

FIG. 18A and FIGS. 18B and 18C (repeated FIGS. 13 and 14) are sketches of example equipment for performing the special grain crushing process 30 from several views. FIG. 18 is the grain crushing apparatus prototype 200P. . . . The following explanation and description of FIGS. 18B and 18C (repeated FIGS. 13 and 14) are excerpted from the above paragraphs. All references should be interpreted as if that application Ser. No. 13/558,938 is fully incorporated herein as to the full apparatus 200. In FIG. 18B (repeated FIG. 13) the roller carrier assembly 210 includes a first mount plate 212 and a second mount plate 213 that are spaced apart from one another in the first direction 80. The roller carrier assembly 210 also includes a first support shaft 120 and a second support shaft 121 that are positioned transverse to the first and second sidewalls 112, 113 and the first and second mount plate 212, 213 and extend through the first and second sidewalls 112, 113 and the first and second mount plates 212, 213. Each of the first and second support shafts 120, 121 (with the spacing distance 86) have an axis of rotation 122 (not shown) around which the first or second support shaft 120, 121 rotates. The first and second mount plate 212, 213 include bearing elements 215 that contact the first or second support shaft 120, 121 and maintain the position of the first and second support shafts 120, 121 relative to the first and second mount plates 212, 213. The first support shaft 120 and the second support shaft 121 are spaced apart from one another a spacing distance 88 in the second direction 82 normal to the first direction 80. In the embodiment depicted, the axes of rotation 122 of the first and second support shafts 120, 121 are generally perpendicular to the first and second sidewalls 112, 113 of the mill body 102 (not shown) and the first and second mount plates 212, 213 of the roller carrier assembly 210. The roller carrier assembly 210 further includes a first grain crushing roller 126 coupled to the first support shaft 120 and a second grain crushing roller 127 coupled to the second support shaft 121.

Repeating further, the first support shaft 120 is secured to the first and second mount plates 212, 213 of the roller carrier assembly 210 with a first shaft clamp 216. Similarly, the second support shaft 121 is secured to the first and second mount plates 212, 213 with a second shaft clamp 217 (not shown). The first and second shaft clamps 216, 217 may be selectively removed from the first or second support shaft 120, 121, thereby disengaging the first or second support shaft 120, 121 from the first and second mount plates 212, 213. By disengaging the first or second shaft clamps 216, 217 from the respective first or second support shaft 120, 121, the respective first or second grain crushing roller 126, 127 may be selectively removed from the roller carrier assembly 210. As such, the first and second grain crushing roller 126 may be interchanged with alternative grain crushing rollers 126, 127, including those having different outer diameters 130 and root diameters 131. By varying the clearance distance between the teeth 129 and the root diameters 131, first and second grain crushing rollers 126, 127 may be fitted within the roller carrier assembly 210 to process grain to the desired consistency.

Referring now to the FIG. 18C (repeated FIG. 14), cross-sectional views of the roller carrier assembly 210 including various sized first and second grain crushing rollers 126, 127 are depicted. Similar to the discussion hereinabove, the first and second grain crushing rollers 126, 127 each teeth 129 that project away from a root diameter 131 towards an outer diameter 130. The distance between the outer diameter 130 of the teeth 129 and the root diameter 131 of the first and second grain crushing rollers 126, 127 is defined as the tooth height 99. The grain crushing rollers 126 are sized and positioned such that the teeth 129 of the corresponding first and second grain crushing rollers 126, 127 intermesh with one another. The first and second grain crushing rollers 126, 127 are spaced apart from one another a spacing distance 88 (i.e., the distance between the respective axis of rotation 122) that provides clearance between teeth 129 of the adjacent first and second grain crushing rollers 126, 127. The relative positioning between the teeth 129 is controlled such that a minimum spacing is maintained between the teeth 129. The first and second grain crushing rollers 126, 127 are maintained at a position spaced apart from one another an overlap distance 88 less than the tooth height 99. The outer diameter 130 of the first and second grain crushing rollers 126, 127 intersect one another, while the root diameters 131 of the first and second grain crushing rollers 126, 127 do not intersect one another.

Further, the first and second grain crushing rollers 126, 127 are installed into the space provided between the first and second mount plates 212, 213 of the roller carrier assembly 210 such that the teeth 129 of the rolls at least partially intermesh with one another. The first and second grain crushing rollers 126, 127 may be spaced apart from one another such that there is not complete engagement of the intermeshed teeth 129 of adjacent first and second grain crushing rollers 126, 127, such that is some clearance between the outer diameter 130 of one of the first and second grain crushing rollers 126, 127 and the root diameter 131 of the opposite of the first and second grain crushing rollers 126, 127. This spacing distance 88 may be set by the combination of the root diameter 131 and outer diameter 130 of each of the first and second grain crushing rollers 126, 127 and the distance between the support shafts 120, 121 about which the first and second grain crushing rollers 126, 127 are adapted to rotate.

In the embodiments depicted in FIG. 18C (repeated FIG. 14), the first and second support shaft 120, 121 are maintained at the same spacing distance 88 relative to one another. To modify the size of particles produced by the grain crushing apparatus 200, spacing between the first and second grain crushing rollers 126, 127 may be modified. To modify spacing between the first and second grain crushing rollers 126, 127, the roller carrier assembly 210 may be disengaged from the first and second sidewalls 112, 113 of the mill body 102 (not shown) and the alignment openings 218 may be slid over the lateral mounting shafts 220, such that the roller carrier assembly 210 is positioned in the deployed position (as depicted in FIG. 3 B. With the roller carrier assembly 210 positioned in the deployed position, the first and/or second shaft clamps 216, 217 may be removed from the respective first and/or second shaft 120, 121. The first and/or second shaft 120, 121 may be temporarily removed from the roller carrier assembly 210, thereby allowing the first and/or second grain crushing roller 126, 127 to be removed from the roller carrier assembly 210 and a replacement grain crushing roller 126*b*, 127*b* to be fitted in its place. As such, a variety of grain crushing rollers 126, 126*b*, 127, 127*b* having various sized outer diameters 130, root diameters 131, and teeth 129 may be provided such that the grain crushing rollers 126, 127 may be fitted by an end-user of the grain crushing apparatus 200 within the roller carrier assembly 210, as to modify the relative fineness/coarseness of the grain processed by the grain crushing apparatus.

FIGS. 19 A through 19 E are sketches of a grain basics and features shown for typical grain parts. Demonstrated here are the basics of the grain. Shown in FIGS. 19 C and 19 D are: the kernel endosperm 50; pericarp 51; germ and germ sack or pouch/clump of cells 52; and tip cap 53. Also shown in FIG. 19 A is a pile 54 of crushed grain and in FIG. 19 B several typical grains 55—in the preprocess stage. FIG. 19 E shows the commonly named nutrients 56 from kernel.

FIGS. 20 A through 20 D are sketches of a typical kernel of grain (corn) showing the way the parts (clumps and florets) and pieces divide and split during a special grain crushing process. Here are demonstrated in the increasingly larger sketches: typical kernel enlarged photo 57; sketch 58 of enlarged kernel; enlarged sketch 58A of enlarged kernel; an enlarged section 59 of kernel as small clump or floret; and multi-sized pieces 60 of the clump or pieces after crushing. The key of all this is that the process preserves the germ pouch by crushing the "staff of life" along the pre-stressed lines and florets that are a natural grain make-up. No cutting and rupturing such as found in the milling alternative process. By controlling the micron size all good value in feed will be used in the digestion process. There will be no waste of food, better feed conversions, less toxins emitted from wastes and more profit for feed lot operations.

FIGS. 21 A through 21 D are graphs and tables for typical milling corn processes. The graphs, tables and charts depict how milled corn divides. Here in these figures are seen sieve values 61 shown as micron sizes for reference in Tables 22-25; weights 62 in grams of corn kernel of specific sieve or micron sized particles; bar graph 63 of sample corn kernel weights of table 62 in FIG. 21 B, and another example 64 (not 21 B) of line graph of sample corn kernel weights. Of special note is that the distribution of particle sizes are a normal distribution from very coarse to dust and powder. This is contrasted in FIG. 26 with the results of the special grain crushing process 30 (all steps) a/k/a micro crushing.

The tables shown in FIGS. 22 A and 22 B, 23 A through 23 D, 24 A through 24 D, and 25 A and 25 B depict several categories and empirical data derived from testing various types of grain and using the special grain crushing process 30 a/k/a micro crushing (particularly iterations of the crushing 41). The chemical and nutrient analyses were carried out by a certified laboratory and then the results were provided in tabular form to inventor John Bihn. FIGS. 22 A and 22 B are tables 70 for analysis of crushed corn using the special grain crushing process. FIGS. 23 A through 23 D are other tables 71 with more crushed corn results using the special grain crushing process. FIG. 24 A through 24 D are other tables 72 with crushed wheat results using the special grain crushing process. FIGS. 25 A and 25 B are tables 73 with crushed corn and wheat results using the special grain crushing process.

FIGS. 26 A and 26 B are tables 77 showing the confirmation table of analysis of tight and controlled crush process and resultant grouping for several animals completed by Purdue University and measured by University of Missouri of the results of the various sized openings 45 used in the grain crushing apparatus 200 and micro crushing process 30. One notes the significantly higher protein grain content compared to other grain processing such as milling and the like.

FIGS. 27 A through 27 F are graphs of the results for various crushing (left) and typical milling (right side) with the tight crush results over-laid to easily compare the results of the crush versus milling processes. One should remember the full distribution shown above with the milled corn. Particle sizes were uncontrolled and varied from coarse to dust. Here the results may be tightly controlled in one grouping to benefit specific animal types. Shown here are: Table 74 of analysis of tight and controlled crush process and resultant grouping of coarse processed grain for large animals such as horses and cows—FIG. 27 A; a tight and controlled crush process and resultant grouping 74A for large animals such as horses and cows of the coarse processed grain interposed over typical milled corn of a normally distributed particle size from very coarse to inedible dust—FIG. 27 B; Table 75 of analysis of tight and controlled crush process and resultant grouping medium coarse processed grain for large animals such as hogs—FIG. 27 C; a tight and controlled crush process and resultant grouping 75A for large animals such as hogs of the medium coarse processed grain interposed over typical milled corn of a normally distributed particle size from very coarse to inedible dust—FIG. 27 D; Table 76 of analysis of tight and controlled crush process and resultant grouping of medium fine processed grain for animals such as poultry—FIG. 27 E; and a tight and controlled crush process and resultant grouping 76A for large animals such as poultry with the medium fine processed grain interposed over typical milled corn of a normally distributed particle size from very coarse to inedible dust—FIG. 27 F. The large, ruminant animals 74, 74A with multiple digestive stomachs (multi-gastric) such as cows and horses have time for fermentation-like digestion. Therefore the fine micron/flours and dust support the micro bacteria to feed and breakdown the grain. The medium animals 75, 75A such as hogs and the like have mono-gastric systems and stomachs that prefer no dust and specific fines or flour like grain for optimum digestion. The poultry—chickens, turkey and the like 76, 76A prefer specifically sized feed for optimum digestion. Therefore the ability to process the grain through the device and enable a controlled, tight size of the respective processed granules may be "dialed in" for the animal to ingest the processed grain.

The details mentioned here are exemplary and not limiting. Other specific process, methods and manners specific to processing grain as described by the embodiments of the special grain crushing process may be added as a person having ordinary skill in the field of grain crushing processes and uses in the art of grain crushing, milling and post-harvest preparation methods and equipment devices and their uses well appreciates.

OPERATION OF THE PREFERRED EMBODIMENT

The special grain crushing process has been described in the above embodiment. The manner of how the device operates is described below. One notes well that the description above and the operation described here must be taken together to fully illustrate the concept of the special grain crushing process.

An explanation of how this special grain crushing process applies is helpful to understand the operation. In this example corn is used, but any grain can give one user a significant amount of savings. This savings shown is also for grain only; a user's savings could potentially amount to more if the user is trucking grain in or out, putting additives into ones feed, etc. In a communication with one of the leading agriculture universities it was stated if the particle size of corn can be reduced to a 400-450 micron size a user can possibly save 10% of the grain needed to feed a hog to market finish. Thus if it takes 9 bushels of corn to finish a hog then 10% of 9 bushels is 0.9↑ per bushel×$8.00 per bushel which would save the user $7.20 per hog.

If 10-12 day old pigs can be ready for market in 26 weeks just by changing the feed to a 400-450 micron size one user will reduce that time to market two 24 weeks. Then rather than 2.0 groups per year a user can raise 2.167 groups per year and one can raise 2,167 groups per year from the same barn. Therefore from a 1,000 head hog barn the user will produce 2,167 hogs, saving $7.20 grain on each hog which equals a $15,602.40 savings on grain.

In addition, because of better digestive efficiencies the hog will produce 20% less waste. Using 400 gallons of waste to be a good figure of waste per hog, 400 gallons of waste×20% equals 80 gallons of waste and 80 gallons of waste×2.167 hogs equals 173,360 gallons of waste therefore the cost of getting rid of waste is 0.5¢ per gallon×173,360 gallons equals $8,668.00 per year for a 1,000 head barn therefore savings for 1,000 head barn per year where pigs are brought in 10-12 days old and finished in a six month cycle are:

| | |
|---|---|
| $15,602.40 | −grain |
| $8,668.00 | −manure waste |
| $24,270.40 | −total savings |

Plus the EPA will be happy because of toxin pollution reduction due to the grain being totally digested before becoming waste.

Why the special grain crushing process works

30% of wheat processed by modern cutting mills is removed from the flour due to the milling process and fed back to livestock in the form of wheat midds etc.

Modern day cutting mill processing requires baking at heat temperatures that kill 100% of the viable nutrients causing the remaining 70% to be nutritionally void.

The crushing process (a/k/a BIHN 3) eliminates the need to separate or add nutrients natural to the product and protects nutrient value of all forms of grain whether it is wheat, corn, rice, rye, or popcorn etc.

With this description it is to be understood that the special grain crushing process is not to be limited to only the disclosed embodiment of product. The features of the special grain crushing process are intended to cover various modifications and equivalent arrangements included within the spirit and scope of the above description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless they are defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other of the embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language References to specific examples, use of "i.e.," use of the word "invention," etc., are not meant to otherwise restrict the scope of the recited claim terms. Nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless they are otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. For the purposes of describing and defining the present invention it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method for processing grain without rupturing a germ pouch, the method comprising the following steps in series:

a) preparing the grain for storing, said preparing comprised of harvesting and combining the grain and cleaning the grain by removing non-organic rocks, dirt, and excess silage;

b) placing the grain in a long term storage elevators and/or a grain lot;

c) storing the grain in the long term storage elevators and/or a grain lot;

d) providing a device that can incrementally crush the grain into a group of multi-sized pieces of the grain wherein the incrementally crushing device includes a plurality of locator blocks which control or maintain a spacing or gap in between a set of teeth on two opposing rollers, the spacing or gap sufficient in size to protect the germ pouch from rupturing by tightly controlling the size of crushed grain;

e) pre-adjusting the spacing or gap in between the set of teeth on the two opposing rollers;

f) transferring the grain from the long term storage elevators and/or a grain lot to the incrementally crushing device; and g) incrementally crushing the grain in the incrementally crushing device with at least one pass through the incrementally crushing device which transforms the grain into a group of multi-sized pieces of the crushed grain wherein the method protects the germ pouch with the spacing and thereby prevents the multi-sized pieces of the grain from releasing oils and becoming rancid.

2. The method in claim 1, wherein the method for processing further comprises the step of processing the crushed grain and multi-sized pieces through a sieve wherein the sieve provides a tightly controlled size of the multi sized pieces of the crushed grain and continues to preserve the germ pouch from being cut and rupturing.

3. The method in claim 1, wherein the method further comprises a secondary processing to reduce the moisture content of the crushed grain.

4. The method in claim 3 wherein the secondary processing to reduce the moisture content of the crushed grain is selected from the group consisting of heating the multi-sized pieces of the crushed grain, cooling the multi-sized pieces of the crushed grain, and vacuuming the multi-sized pieces of the crushed grain.

5. The method in claim 1 wherein the spacing in between the set of teeth on the two opposing rollers of the incrementally crushing device further comprises a minimum spacing or gap that is selected from the size group consisting of a coarse spacing with an approximately No. 16 US sieve distribution, a medium coarse spacing with an approximately No. 40 US sieve distribution, and a medium fine coarse spacing with an approximately No. 100 US sieve distribution.

* * * * *